US006846102B2

(12) United States Patent
Yamamoto et al.

(10) Patent No.: US 6,846,102 B2
(45) Date of Patent: Jan. 25, 2005

(54) GRAIN AGITATING APPARATUS AND GRAIN STORING APPARATUS

(75) Inventors: Souichi Yamamoto, Tendo (JP); Mamoru Abe, Tendo (JP); Eiji Oyama, Tendo (JP)

(73) Assignee: Kabushiki Kaisha Yamamoto-Seisakusho, Yamagata-ken (JP)

( * ) Notice: Subject to any disclaimer, the term of this patent is extended or adjusted under 35 U.S.C. 154(b) by 55 days.

(21) Appl. No.: 10/386,719

(22) Filed: Mar. 13, 2003

(65) Prior Publication Data

US 2004/0022121 A1 Feb. 5, 2004

(30) Foreign Application Priority Data

Jul. 30, 2002 (JP) ..... 2002-221568
Aug. 1, 2002 (JP) ..... 2002-224927
Aug. 2, 2002 (JP) ..... 2002-226376

(51) Int. Cl.[7] ..... B01F 7/24
(52) U.S. Cl. ..... 366/261
(58) Field of Search ..... 366/186, 241, 366/261, 266, 287, 288, 297–300, 318, 345–346, 603

(56) References Cited

U.S. PATENT DOCUMENTS 3,487,961 A * 1/1970 Neuenschwander
3,580,549 A * 5/1971 Murphy
3,584,842 A * 6/1971 Sukup
3,592,447 A * 7/1971 Steffen
3,776,512 A * 12/1973 McKinnon
4,162,857 A * 7/1979 Spurling
4,248,538 A * 2/1981 Sukup
4,274,750 A * 6/1981 Smit
4,322,171 A * 3/1982 Clark
4,340,310 A * 7/1982 Clark
4,374,621 A * 2/1983 Stille
4,836,686 A * 6/1989 Sukup
4,854,719 A * 8/1989 Sukup
5,570,954 A * 11/1996 Sukup

FOREIGN PATENT DOCUMENTS

| | | | |
|---|---|---|---|
| FR | 2259639 | * | 8/1975 |
| JP | 6-197624 | * | 7/1994 |
| JP | 6-197625 | * | 7/1994 |
| JP | 6-233623 | * | 8/1994 |
| JP | 6-233624 | * | 8/1994 |
| JP | 09-12151 | | 1/1997 |
| JP | 10-56872 | * | 3/1998 |
| JP | 2003-274748 | * | 9/2001 |
| JP | 2004-66058 | * | 3/2004 |
| JP | 2004-66068 | * | 3/2004 |
| JP | 2001-321655 | * | 11/2004 |

* cited by examiner

*Primary Examiner*—Charles E. Cooley
(74) *Attorney, Agent, or Firm*—Taiyo, Nakajima & Kato

(57) ABSTRACT

In an agitating machine, an axial direction of a drive roll is inclined to one side or another side with respect to an axial direction of a guide shaft which is rotated on its own axis, whereby a drive support machine casing and a driven support machine casing are moved to one end side or another end side of the guide shaft. When an arrival detecting apparatus detects that the drive support machine casing or the driven support machine casing has reached the one end side or the another end side of the guide shaft, a control apparatus drives a reversing motor so as to incline the axial direction of the drive roll to the another side or the one side. Since the arrival detecting apparatus, the reversing motor and the control apparatus are electrically driven, it is possible to securely incline the axial direction of the drive roll.

20 Claims, 20 Drawing Sheets

GRAIN AGITATING APPARATUS AND GRAIN STORING APPARATUS

BACKGROUND OF THE INVENTION

1. Field of the Invention

The present invention relates to a grain agitating apparatus for agitating grain stored in a grain tank, and a grain storing apparatus in which the grain agitating apparatus is provided.

2. Description of the Related Art

As an accumulating, agitating, mixing, drying and storing apparatus, for example, there is a structure described in Japanese Patent Application Laid-Open (JP-A) No. 9-12151. The accumulating, agitating, mixing, drying and storing apparatus is provided with a grain tank. Rough rice is fed in the grain tank so as to be accumulated and stored. Dry wind is blown into the grain tank. Accordingly, the rough rice stored in the grain tank is dried up.

An agitating machine 200 shown in FIG. 18 is provided within the grain tank. The agitating machine 200 is provided with a cylindrical guide shaft 202. The guide shaft 202 is provided at an upper portion within the grain tank. The guide shaft 202 is always rotated on its own axis in one direction around a center axis. The guide shaft 202 is always revolved on a horizontal surface in one direction around one end side.

A reversing plate 206 and a reversing plate 204 are respectively fixed to a portion near the one end and a portion near another end of the guide shaft 202. The reversing plates 204 and 206 are integrally rotated with the guide shaft 202 on their own axes. The reversing plates 204 and 206 are formed in a ring plate shape. A plurality of oblong holes 208 are formed at peripheral portions of the reversing plates 204 and 206 with uniform intervals.

A fixed support machine casing 210, a driven support machine casing 212 and a drive support machine casing 214 which are substantially formed in an inverse pentagonal tube shape are supported by the guide shaft 202 from the another end side to the one end side. The fixed support machine casing 210, the driven support machine casing 212 and the drive support machine casing 214 surround the guide shaft 202. The fixed support machine casing 210, the driven support machine casing 212 and the drive support machine casing 214 are made rotatable with respect to the guide shaft 202. Accordingly, the fixed support machine casing 210, the driven support machine casing 212 and the drive support machine casing 214 are structured such as to allow the guide shaft 202 to rotate on its own axis. Further, the fixed support machine casing 210 is arranged at the another end side of the guide shaft 202 from the reversing plate 204. The driven support machine casing 212 and the drive support machine casing 214 are arranged between the reversing plate 204 and the reversing plate 206. The driven support machine casing 212 and the drive support machine casing 214 is structured such as to move in an axial direction of the guide shaft 202.

As shown in FIG. 20, a plurality of bearings 238 are provided within the driven support machine casing 212. Each of the bearings 238 has a holding portion 240 and a spherical rotating portion 242. Each of the holding portions 240 is fixed to an inner surface of the driven support machine casing 212. Each of the rotating portions 242 is rotatably held to each of the holding portions 240 in a state of being partly covered by each of the holding portions 240. Each of the bearings 238 is in contact with a peripheral surface of the guide shaft 202 in the rotating portion 242.

Accordingly, the driven support machine casing 212 is supported by the guide shaft 202 as mentioned above, allows the guide shaft 202 to rotate on its own axis, and is structured such as to be capable of moving in the axial direction of the guide shaft 202.

The fixed support machine casing 210, the driven support machine casing 212 and the drive support machine casing 214 respectively support upper portions of down augers 216. Each of the down augers 216 is inserted into the rough rice within the grain tank. Each of the down augers 216 is revolved integrally with the revolution of the guide shaft 202. Each of the down augers 216 is rotated on its own axis around the center axis. Accordingly, the rough rice within the grain tank is agitated (mixed).

The driven support machine casing 212 and the drive support machine casing 214 are connected by a connection lever 218. Accordingly, the driven support machine casing 212 and the drive support machine casing 214 are inhibited from relatively moving in the axial direction of the guide shaft 202.

As shown in FIGS. 19A and 19B, one end of a reversing arm 220 is rotatably supported by a lower surface of an upper wall of the driven support machine casing 212 at a side end toward the reversing plate 204. One end of a reversing rod 222 is rotatably connected to another end of the reversing arm 220. A reversing pin 224 is fixed to the one end of the reversing arm 220. The reversing pin 224 protrudes to a side of the reversing plate 204 from the driven support machine casing 212.

A passive gear 226 is rotatably supported by a lower surface of an upper wall of the drive support machine casing 214 at the side end toward the reversing plate 204. A passive arm 228 is fixed to the passive gear 226. Another end of the reversing rod 222 is rotatably connected to one end of the passive arm 228.

A reversing gear 230 is rotatably supported by the lower surface of the upper wall of the drive support machine casing 214 at a side end toward the reversing plate 206. A reversing pin 232 is fixed to the reversing gear 230. The reversing pin 232 protrudes to a side of the reversing plate 206 from the drive support machine casing 214.

A support gear 234 is rotatably supported by the lower surface of the upper wall of the drive support machine casing 214 at a center thereof. The support gear 234 is engaged with the passive gear 226 and the reversing gear 230. The support gear 234 supports a cylindrical drive roll 236. The drive roll 236 is brought into contact with the peripheral surface of the guide shaft 202. Accordingly, the drive roll 236 is rotated around the peripheral surface of the guide shaft 202 due to the rotation of the guide shaft 202. Further, the support gear 234 is rotated, whereby a direction of incline of the drive roll 236 in the axial direction with respect to the axial direction of the guide shaft 202 is changed.

In this case, as shown in FIG. 19A, when the axial direction of the drive roll 236 is inclined to one side with respect to the axial direction of the guide shaft 202 (when the side of the drive roll 236 opposite to the rotation direction of the guide shaft 202 is inclined to the side of the reversing plate 206), the drive support machine casing 214 and the driven support machine casing 212 are moved to the side of the reversing plate 206. At this time, the reversing pin 232 is inclined to the side opposite to the rotation direction of the guide shaft 202 with respect to the axial direction of the guide shaft 202, and the reversing pin 224 is inclined to the side of the rotation direction of the guide shaft 202 with respect to the axial direction of the guide shaft 202.

Thereafter, when the drive support machine casing 214 has reached the reversing plate 206, the reversing pin 232 is inserted to the oblong hole 208 of the reversing plate 206. Accordingly, the reversing pin 232 is inclined to the side of the rotation direction of the guide shaft 202 with respect to the axial direction of the guide shaft 202, and the reversing gear 230 and the support gear 234 are rotated. Therefore, as shown in FIG. 19B, the axial direction of the drive roll 236 is inclined to another side with respect to the axial direction of the guide shaft 202 (the side of the drive roll 236 opposite to the rotation direction of the guide shaft 202 is inclined to the side of the reversing plate 204). Accordingly, the drive support machine casing 214 and the driven support machine casing 212 are moved to the side of the reversing plate 204. Further, the passive gear 226 is rotated due to the rotation of the support gear 234, and the reversing arm 220 is rotated via the reversing rod 222. Therefore, the reversing pin 224 is inclined to the side opposite to the rotation direction of the guide shaft 202 with respect to the axial direction of the guide shaft 202.

Further, when the driven support machine casing 212 has reached the reversing plate 204, the reversing pin 224 is inserted to the oblong hole 208 of the reversing plate 204. Accordingly, as shown in FIG. 19A again, the reversing pin 224 is inclined to the side of the rotation direction of the guide shaft 202 with respect to the axial direction of the guide shaft 202, and the reversing arm 220 is rotated. Therefore, the passive gear 226 and the support gear 234 are rotated via the reversing rod 222. Accordingly, the axial direction of the drive roll 236 is inclined to the one side with respect to the axial direction of the guide shaft 202, and the drive support machine casing 214 and the driven support machine casing 212 are moved to the side of the reversing plate 206. Further, the reversing gear 230 is rotated due to the rotation of the support gear 234. Accordingly, the reversing pin 232 is inclined to the side opposite to the rotation direction of the guide shaft 202 with respect to the axial direction of the guide shaft 202.

Accordingly, the movement of the drive support machine casing 214 and the driven support machine casing 212 to the one end side of the guide shaft 202 is reversed when the drive support machine casing 214 has reached the reversing plate 206. Further, the movement of the drive support machine casing 214 and the driven support machine casing 212 to the another end side of the guide shaft 202 is reversed when the driven support machine casing 212 has reached the reversing plate 204. Accordingly, the drive support machine casing 214 and the driven support machine casing 212 are both oscillated in the axial direction of the guide shaft 202 between the reversing plate 204 and the reversing plate 206. Therefore, the down augers 216 of the drive support machine casing 214 and the driven support machine casing 212 are oscillated in the axial direction of the guide shaft 202 integrally with the drive support machine casing 214 and the driven support machine casing 212. Accordingly, the structure is made such that the rough rice within the grain tank is uniformly agitated.

However, in the agitating machine 200 mentioned above, a mechanism for changing the direction of incline of the drive roll 236 is a mechanical mechanism constituted by the oblong holes 208 of the reversing plates 204 and 206, the reversing arm 220, the reversing rod 222, the passive gear 226, the passive arm 228, the support gear 234, the reversing gear 230 and the reversing pins 224 and 232. Accordingly, abrasion, looseness or the like may be generated in the mechanism for changing the direction of incline of the drive roll 236. Accordingly, there is generated a case that the reversing pin 232 or the reversing pin 224 is not inclined with respect to the axial direction of the guide shaft 202 when the drive support machine casing 214 or the driven support machine casing 212 has reached the reversing plate 206 or the reversing plate 204. Therefore, the axial direction of the drive roll 236 becomes substantially parallel to the axial direction of the guide shaft 202, and there is a possibility that the drive support machine casing 214 and the driven support machine casing 212 can not oscillate the guide shaft 202.

In the case mentioned above, only the rough rice in a fixed part within the grain tank is agitated, and the rough rice within the grain tank can not be uniformly agitated. Accordingly, a dry spot is significantly generated in the rough rice, and a quality deterioration trouble is generated in the rough rice.

Further, in this case, the drive roll 236 rotates only a fixed portion of the peripheral surface of the guide shaft 202. Accordingly, there is also generated a trouble that the fixed portion of the peripheral surface of the guide shaft 202 is abraded and recessed. Therefore, the guide shaft 202 can not be repaired.

In this case, since an interior side of the grain tank is in a sealed state, it is impossible to monitor an inclined circumstance of the drive roll 236. Further, even in the case that the inclined circumstance of the drive roll 236 can be monitored, it is impossible to always monitor the inclined circumstance of the drive roll 236. Accordingly, the quality deterioration trouble of the rough rice and the abrasion trouble of the guide shaft 202 are frequently unknown for a long time.

Further, as mentioned above, the guide shaft 202 supporting the driven support machine casing 212 rotates on its own axis. Further, the driven support machine casing 212 is moved in the axial direction of the guide shaft 202. Accordingly, it is necessary that the rotating portion 242 of the bearing 238 provided within the driven support machine casing 212 spirally rotates around the peripheral surface of the guide shaft 202. Further, the driven support machine casing 212 is oscillated in the axial direction of the guide shaft 202. Therefore, a spiral moving track of the rotating portion 242 with respect to the peripheral surface of the guide shaft 202 is set reverse in the direction of incline between the moving time of the driven support machine casing 212 to the one end side of the guide shaft 202 and the moving time of the driven support machine casing 212 to the another end side of the guide shaft 202. Accordingly, the bearing 238 is formed as a so-called free bearing. Thus, the spherical rotating portion 242 is made rotatable in an optional direction with respect to the holding portion 240.

However, a great deal of dust generated by the dried rough rice exist within the grain tank. Accordingly, in the bearing 238 (the free bearing), a rotating performance (a lubricating performance between the holding portion 240 and the rotating portion 242) of the rotating portion 242 which is rotatable in the optional direction with respect to the holding portion 240 tends to be deteriorated. Accordingly, a service life of the bearing 238 (particularly, the bearing 238 arranged at the upper portion of the driven support machine casing 212) is short. Therefore, there is a problem that a maintenance of the agitating machine 200 is required for a short period.

SUMMARY OF THE INVENTION

The present invention is made by taking the facts mentioned above into consideration, and an object of the invention is to provide a grain agitating apparatus and a grain storing apparatus which can securely incline an axial direction of a drive roll with respect to an axial direction of a guide shaft, a grain agitating apparatus and a grain storing apparatus which can previously prevent a dry spot from being generated in grain and prevent a guide shaft from being ineffective for repair, and a grain agitating apparatus and a grain storing apparatus which can make a period required for maintenance long.

According to a first aspect of the invention, there is provided a grain agitating apparatus comprising: a guide shaft which is provided in a grain tank in which grain is stored; a drive roll which is brought into contact with a peripheral surface of the guide shaft, is rotated around the peripheral surface of the guide shaft when an axial direction thereof is inclined to one side with respect to an axial direction of the guide shaft, thereby being moved to one end side of the guide shaft, and is rotated around the peripheral surface of the guide shaft when the axial direction thereof is inclined to another side with respect to the axial direction of the guide shaft, thereby being moved to another end side of the guide shaft; a reversing component which is electrically driven, inclines the axial direction of the drive roll to the another side with respect to the axial direction of the guide shaft when it is detected that the drive roll has been moved to a movement limit position at the one end side of the guide shaft, and inclines the axial direction of the drive roll to the one side with respect to the axial direction of the guide shaft when it is detected that the drive roll has been moved to a movement limit position at the another end side of the guide shaft; and an agitating member which is moved integrally with the drive roll, is inserted into the grain, and agitates the grain.

In the grain agitating apparatus according to the first aspect, the drive roll is brought into contact with the peripheral surface of the guide shaft provided in the grain tank in which the grain is stored. Since the drive roll is rotated around the peripheral surface of the guide shaft when the axial direction of the drive roll is inclined to the one side with respect to the axial direction of the guide shaft, the drive roll is moved to the one end side of the guide shaft. Since the drive roll is rotated around the peripheral surface of the guide shaft when the axial direction of the drive roll is inclined to the another side with respect to the axial direction of the guide shaft, the drive roll is moved to the another end side of the guide shaft.

Further, when the reversing component detects that the drive roll has been moved to the movement limit position at the one end side of the guide shaft, the reversing component inclines the axial direction of the drive roll to the another side with respect to the axial direction of the guide shaft. Accordingly, the drive roll is moved to the another end side of the guide shaft. On the other hand, when the reversing component detects that the drive roll has been moved to the movement limit position at the another end side of the guide shaft, the reversing component inclines the axial direction of the drive roll to the one side with respect to the axial direction of the guide shaft. Accordingly, the drive roll is moved to the one end side of the guide shaft.

Therefore, the drive roll is oscillated between the movement limit position at the one end side of the guide shaft and the movement limit position at the another end side of the guide shaft. Accordingly, the agitating member inserted into the grain is oscillated integrally with the drive roll, thereby agitating the grain.

In this case, the reversing component is electrically driven. Therefore, the axial direction of the drive roll is securely inclined to the another side with respect to the axial direction of the guide shaft when the drive roll has been moved to the movement limit position at the one end side of the guide shaft. Further, the axial direction of the drive roll can be securely inclined to the one side with respect to the axial direction of the guide shaft when the drive roll has been moved to the movement limit position at the another end side of the guide shaft. Accordingly, it is possible to securely incline the axial direction of the drive roll with respect to the axial direction of the guide shaft. Therefore, the drive roll can securely oscillate the guide shaft.

Accordingly, it is possible to prevent the agitating member from agitating the grain in a fixed part within the grain tank. Therefore, it is possible to securely agitate the grain within the grain tank uniformly. Thus, in the case that a dry wing is blown into the grain tank and the grain is dried, it is possible to prevent the dry spot from being generated in the grain. Accordingly, it is possible to prevent a quality deterioration trouble from being generated in the grain, and it is possible to finish the grain having a high quality.

Further, it is possible to prevent the drive roll from rotating only a fixed portion of the guide shaft peripheral surface, and it is possible to prevent the peripheral surface of the guide shaft from being locally abraded (recessed). Accordingly, it is possible to prevent the guide shaft from being ineffective for repair.

Further, the reversing component is electrically driven as mentioned above. Accordingly, it is possible to simplify the mechanism for changing the direction of incline of the drive roll with respect to the axial direction of the guide shaft. Therefore, it is possible to achieve a cost saving.

According to a second aspect of the invention, there is provided a grain agitating apparatus comprising: a guide shaft which is provided in a grain tank in which dry wind is blown and stored grain is dried; a drive roll which is brought into contact with a peripheral surface of the guide shaft, is rotated around the peripheral surface of the guide shaft when an axial direction thereof is inclined to one side with respect to an axial direction of the guide shaft, thereby being moved to one end side of the guide shaft, and is rotated around the peripheral surface of the guide shaft when the axial direction thereof is inclined to another side with respect to the axial direction of the guide shaft, thereby being moved to another end side of the guide shaft; a reversing component which inclines the axial direction of the drive roll to the another side with respect to the axial direction of the guide shaft when the drive roll has been moved to a movement limit position at the one end side of the guide shaft, and inclines the axial direction of the drive roll to the one side with respect to the axial direction of the guide shaft when the drive roll has been moved to a movement limit position at the another end side of the guide shaft; and an agitating member which is moved integrally with the drive roll, is inserted into the grain, and agitates the grain, wherein the grain agitating apparatus performs at least one of a process of stopping the blowing of dry wind into the grain tank and the rotation of the drive roll with respect to the guide shaft peripheral surface, and a process of giving a warning, when the axial direction of the drive roll becomes parallel to the axial direction of the guide shaft.

In the grain agitating apparatus according to the second aspect, the dry wind is blown into the grain tank in which the grain is stored, whereby the grain is dried.

Further, the drive roll is brought into contact with the peripheral surface of the guide shaft provided in the grain tank. Since the drive roll is rotated around the peripheral surface of the guide shaft when the axial direction of the drive roll is inclined to the one side with respect to the axial direction of the guide shaft, the drive roll is moved to the one end side of the guide shaft. Since the drive roll is rotated around the peripheral surface of the guide shaft when the axial direction of the drive roll is inclined to the another side with respect to the axial direction of the guide shaft, the drive roll is moved to the another end side of the guide shaft.

Further, when the drive roll has been moved to the movement limit position at the one end side of the guide shaft, the reversing component inclines the axial direction of the drive roll to the another side with respect to the axial direction of the guide shaft. Accordingly, the drive roll is moved to the another end side of the guide shaft. On the other hand, when the drive roll has been moved to the movement limit position at the another end side of the guide shaft, the reversing component inclines the axial direction of the drive roll to the one side with respect to the axial direction of the guide shaft. Accordingly, the drive roll is moved to the one end side of the guide shaft.

Therefore, the drive roll is oscillated between the movement limit position at the one end side of the guide shaft and the movement limit position at the another end side of the guide shaft. Accordingly, the agitating member inserted into the grain is oscillated integrally with the drive roll, thereby agitating the grain. Thus, the grain is uniformly agitated and it is possible to prevent the dry spot from being generated in the grain.

In this case, if the axial direction of the drive roll becomes parallel to the axial direction of the guide shaft, the drive roll can not oscillate the guide shaft, and the agitating member can not be oscillated. Therefore, at this time, there is performed at least one of the process of stopping the blowing of dry wind into the grain tank and the rotation of the drive roll with respect to the guide shaft peripheral surface, and the process of giving the warning. Further, it is possible to stop the rotation of the drive roll with respect to the peripheral surface of the guide shaft, for example, by performing the process of stopping the rotation of the guide shaft.

Accordingly, at this time, in the case that only the process of stopping the blowing of dry wind into the train tank and the rotation of the drive roll with respect to the guide shaft peripheral surface is performed, it is possible to previously prevent the dry spot from being generated in the grain. Further, it is possible to prevent the drive roll from rotating only the fixed portion of the guide shaft peripheral surface and it is possible to prevent the peripheral surface of the guide shaft from being locally abraded (recessed). Therefore, it is possible to prevent the guide shaft from being ineffective for repair.

Further, at this time, in the case that only the process of giving the warning is performed, the fact that the agitating member is not oscillated is quickly informed to an operator or the like. Further, the blowing of dry wind into the grain tank is stopped due to a switch operation by the operator or the like, whereby it is possible to prevent previously the dry spot from being generated in the grain. Further, the rotation of the drive roll with respect to the guide shaft peripheral surface is stopped due to the switch operation by the operator or the like, whereby it is possible to prevent the peripheral surface of the guide shaft from being locally abraded and it is possible to prevent the guide shaft from being ineffective for repair.

Further, at this time, in the case that the process of stopping the blowing of dry wind into the grain tank and the rotation of the drive roll with respect to the guide shaft peripheral surface, and the process of giving the warning are performed, it is possible to obtain the same effect as that of the case that only the process of stopping the blowing of dry wind into the grain tank and the rotation of the drive roll with respect to the guide shaft peripheral surface is performed. Further, the fact that the dry wind is not blown into the grain tank is quickly informed by means of the warning. Accordingly, it is possible to prevent the grain from being left within the grain tank in which the dry wind is not blown for a long time. Therefore, it is possible to prevent the grain from being ripe.

According to a third aspect of the invention, there is provided a grain agitating apparatus comprising: a guide shaft which is provided in a grain tank in which grain is stored, and which is rotated on its own axis; a guide rail which has a first roll provided rotatable around a center axis in a direction parallel to an axial direction of the guide shaft, is supported by the guide shaft due to the first roll being in contact with the guide shaft, and allows the guide shaft to rotate on its own axis; a moving member which has a second roll provided rotatable around a center axis in a direction perpendicular to the axial direction of the guide shaft, is supported by the guide rail and is allowed to move in the axial direction of the guide shaft due to the second roll being in contact with the guide rail, and is moved in the axial direction of the guide shaft; and an agitating member which is moved integrally with the moving member, is inserted into the grain, and agitates the grain.

In the grain agitating apparatus according to the third aspect, the guide shaft provided in the grain tank in which the grain is stored is rotated on its own axis. The first roll of the guide rail is in contact with the guide shaft, and the guide rail is supported by the guide shaft. The first roll is made rotatable around the center axis in the parallel direction to the axial direction of the guide shaft. Accordingly, the guide rail allows the guide shaft to rotate on its own axis. Further, the second roll of the moving member is in contact with the guide rail, and the moving member is supported by the guide rail. The second roll is made rotatable around the center axis in the direction perpendicular to the axial direction of the guide shaft. Accordingly, the moving member is allowed to move in the axial direction of the guide shaft.

Further, the moving member is moved in the axial direction of the guide shaft. Further, the agitating member moved integrally with the moving member is inserted into the grain. Accordingly, the agitating member agitates the grain.

In this case, as described above, the first roll and the second roll are structured rotatable around the respective fixed center axes. Accordingly, the first roll and the second roll can be made in a sealed type dustproof structure in which the rotating performance is not deteriorated by the dust or the like. Therefore, it is possible to make a service life of the first roll and the second roll long, and it is possible to make a period required for maintenance in the grain agitating apparatus long.

A grain storing apparatus according to a first aspect of the invention is provided with the grain agitating apparatus according to the first aspect mentioned above; and the grain tank.

A grain storing apparatus according to a second aspect of the invention is provided with the grain agitating apparatus according to the second aspect mentioned above; and the grain tank.

A grain storing apparatus according to a third aspect of the invention is provided with the grain agitating apparatus according to the third aspect mentioned above; and the grain tank.

BRIEF DESCRIPTION OF THE DRAWINGS

FIGS. 15A and 15B are plan views which show a moving condition in which a drive support machine casing and a driven support machine casing move in an axial direction of a guide shaft in the agitating machine according to the third embodiment of the invention, in which FIG. 15A is a view which shows a condition in which the drive support machine casing and the driven support machine casing move to one end side of the guide shaft, and FIG. 15B is a view which shows a condition in which the drive support machine casing and the driven support machine casing move to another end side of the guide shaft.

FIGS. 19A and 19B are plan views which show a moving condition in which a drive support machine casing and a driven support machine casing move in an axial direction of a guide shaft in the conventional agitating machine, in which FIG. 19A is a view which shows a condition in which the drive support machine casing and the driven support machine casing move to one end side of the guide shaft, and FIG. 19B is a view which shows a condition in which the drive support machine casing and the driven support machine casing move to another end side of the guide shaft.

DESCRIPTION OF THE PREFERRED EMBODIMENTS (First Embodiment)

Figure 8:
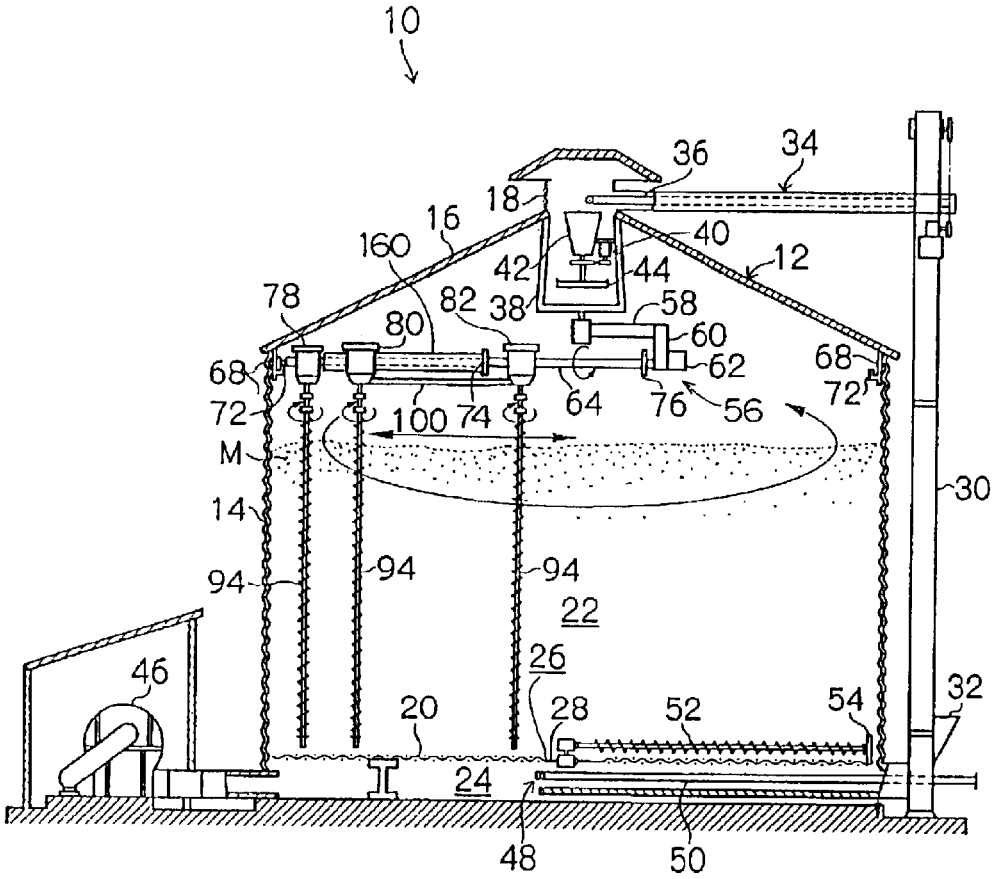
FIG. 8 is a vertical cross sectional view which shows an accumulating, agitating, mixing, drying and storing apparatus according to the first embodiment of the invention.

FIG. 8 shows an accumulating, agitating, mixing, drying and storing apparatus 10 corresponding to a grain storing apparatus according to a first embodiment structured by applying a grain agitating apparatus of the invention, by using a vertical cross sectional view.

The accumulating, agitating, mixing, drying and storing apparatus 10 according to the present embodiment is structured as an outdoor installation type once-through system. The accumulating, agitating, mixing, drying and storing apparatus 10 is provided with a grain tank 12 (a bin). The grain tank 12 has a peripheral wall 14 which is formed in a cylindrical shape or a polygonal shape. An axial direction of the peripheral wall 14 is made parallel to a vertical direction. Further, a top opening of the peripheral wall 14 is covered by a roof 16 formed in a substantially conical shape. An exhaust port 18 is formed at a top portion of the roof 16.

An interior side of the peripheral wall 14 is partitioned by a floor plate 20 near a bottom surface of the peripheral wall 14. The interior side of the peripheral wall 14 at an upper side of the floor plate 20 is formed as a storing chamber 22. The interior side of the peripheral wall 14 at a lower side of the floor plate 20 is formed as a wind introduction passage 24. The floor plate 20 is formed as a net member or the like and has an air permeability. Rough rice M corresponding to grain can not pass through the floor plate 20. Further, a discharge port 26 is formed at a center of the floor plate 20. The discharge port 26 is closed by a discharge lid 28.

A grain elevator 30 is provided near the grain tank 12 in a standing manner. A feeding hopper 32 is provide data lower portion of the grain elevator 30. The rough rice M is fed to the lower portion within the grain elevator 30 from the feeding hopper 32. A bucket conveyor (not shown) is provided within the grain elevator 30. The rough rice M fed to the lower portion within the grain elevator 30 is lifted up and transferred to an upper portion within the grain elevator 30 by the bucket conveyor.

A feeding machine 34 is bridged between the upper portion of the grain elevator 30 and the top portion of the roof 16. The rough rice M transferred to the upper portion within the grain elevator 30 is flown down into the feeding machine 34. A belt conveyor 36 is provided within the feeding machine 34. The rough rice M flown down into the feeding machine 34 is transferred to the top portion within the roof 16 by the belt conveyor 36.

A fixed frame 38 is fixed to a center within the roof 16. An equally dividing machine 40 is fixed within the fixed frame 38. The equally dividing machine 40 has a guide hopper 42. The rough rice M transferred to the top portion within the roof 16 is flown down into the guide hopper 42. A disc-shaped equally dividing plate 44 is provided immediately below the guide hopper 42. The rough rice M flown down into the guide hopper 42 is guided by the guide hopper 42 and flown down into an upper surface of the rotated equally dividing plate 44. Accordingly, the rough rice M is equally radiated and distributed to the storing chamber 22 due to a centrifugal force. Therefore, the rough rice M is fed, accumulated and stored in the storing chamber 22 (within the grain tank 12). Further, the rough rice M is fed into the storing chamber 22 for some days. Further, the rough rice M is stored in the storing chamber 22 for some months.

A dry wind generating apparatus 46 is provided near the grain tank 12. The dry wind generating apparatus 46 is communicated with the wind introduction passage 24. The dry wind generating apparatus 46 generates dry wind (hot wind or natural wind), and feeds the wind to the storing chamber 22 via the wind introduction passage 24 and the floor plate 20. Further, the dry wind is discharged from an exhaust port 18 at the top portion of the roof 16. Accordingly, when the rough rice M is fed into the storing chamber 22 and when the rough rice M is stored in the storing chamber 22, the rough rice M within the storing chamber 22 is exposed to the dry wind and is slowly dried.

A discharging machine 48 is provided at a lower side of the floor plate 20. The discharging machine 48 passes through the lower portion of the peripheral wall 14 via the interior side of the wind introduction passage 24 from the portion immediately below the discharge port 26 at the center of the floor plate 20. Further, the discharging machine 48 is bridged to an indoor (not shown) out of the grain tank 12. At a time of shipping the rough rice M within the storing chamber 22, a discharge lid 28 opens the discharge port 26 and the rough rice M is flown down into the discharging machine 48. A belt conveyor 50 is provided in the discharging machine 48. The rough rice M flown down into the discharging machine 48 is transferred by the belt conveyor 50 and discharged to the indoor.

A discharge auger 52 (a screw) is provided immediately above the floor plate 20. The discharge auger 52 is bridged from the portion immediately above the discharge port 26 to the portion near the peripheral wall 14. The discharge auger 52 is structured such as to freely revolve around a side end of the discharge port 26. A disc-shaped rotating plate 54 is fixed to a side end of the peripheral wall 14 in the discharge auger 52. In this case, in a final stage of discharging the rough rice M within the storing chamber 22, the discharge auger 52 is rotated on its own axis around the center axis. Therefore, the rotating plate 54 rotates the floor plate 20, and the discharge auger 52 is revolved around the side end of the discharge port 26. Accordingly, the rough rice M within the storing chamber 22 is transferred to the discharge port 26 by the discharge auger 52, and the rough rice M is well discharged from the storing chamber 22.

An agitating machine 56 corresponding to the grain agitating apparatus is provided within the storing chamber 22. The agitating machine 56 is provided with a rod-like revolving arm 58. One end of the revolving arm 58 is rotatably supported by the fixed frame 38. The one end of the revolving arm 58 is arranged at a upper portion of the storing chamber 22 and the center axis of the peripheral wall 14. The revolving arm 58 is horizontally arranged. An upper portion of a gear box 60 is fixed to another end of the revolving arm 58. A speed reduction mechanism (not shown) is provided within the gear box 60. A rotating motor 62 is mounted to the gear box 60.

One end of a guide shaft 64 having a cylindrical shape (including a columnar shape as far as it is in a circular axial shape) is supported by a lower portion of the gear box 60, at the lower side of the revolving arm 58. The guide shaft 64 is horizontally arranged in parallel to the revolving arm 58. Another end side of the guide shaft 64 is extended near to the peripheral wall 14 via the portion on the center axis of the peripheral wall 14. A recess portion 66 is formed at all the periphery near another end of the guide shaft 64 (refer to FIG. 9).

Figure 9:
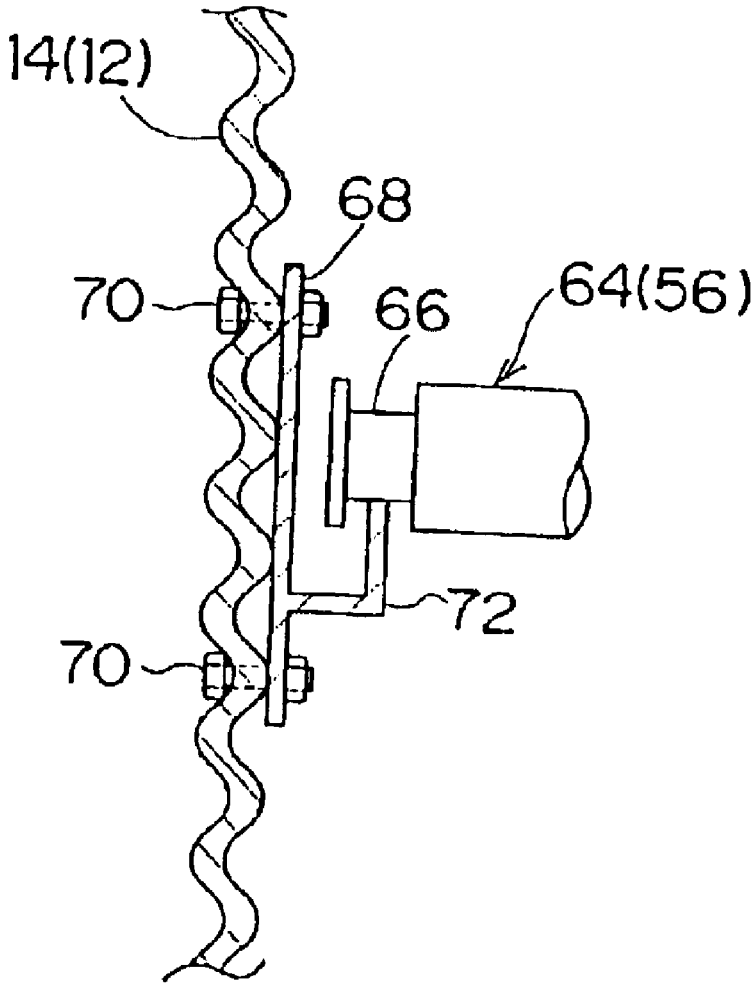
FIG. 9 is a cross sectional view which in detail shows a support condition of another end side of a guide shaft in the accumulating, agitating, mixing, drying and storing apparatus according to the first embodiment of the invention.

As in detail shown in FIG. 9, a cylindrical support tube 68 is fixed to an inner surface of the peripheral wall 14 by a predetermined number of bolts and nuts 70. A rail 72 having an L-shaped cross section is integrally provided all around an inner surface of the support tube 68. A leading end side of the rail 72 protrudes to an upper side. A leading end of the rail 72 is in contact with a bottom surface of the recess portion 66 mentioned above. Accordingly, the rail 72 supports the another end side of the guide shaft 64.

In this case, the guide shaft 64 is connected to an output shaft of the rotating motor 62 via the speed reduction mechanism within the gear box 60. The rotating motor 62 is driven, whereby the rotation of the output shaft of the rotating motor 62 is transmitted to the guide shaft 64 via the speed reduction mechanism. Accordingly, the guide shaft 64 is slowly rotated on its own axis around the center axis. Further, the recess portion 66 of the guide shaft 64 slowly rotates the leading end of the rail 72, and the guide shaft 64 is slowly revolved on the horizontal surface around the center axis of the peripheral wall 14 together with the revolving arm 58, the gear box 60 and the rotating motor 62.

A disc-like reversing plates 74 and 76 corresponding to contacted members constituting a movement detecting component of the reversing component are respectively fixed to the guide shaft 64 substantially at the center in the axial direction and near the one end. The reversing plates 74 and 76 are integrally rotated on its own axis with the guide shaft 64.

Figure 6:
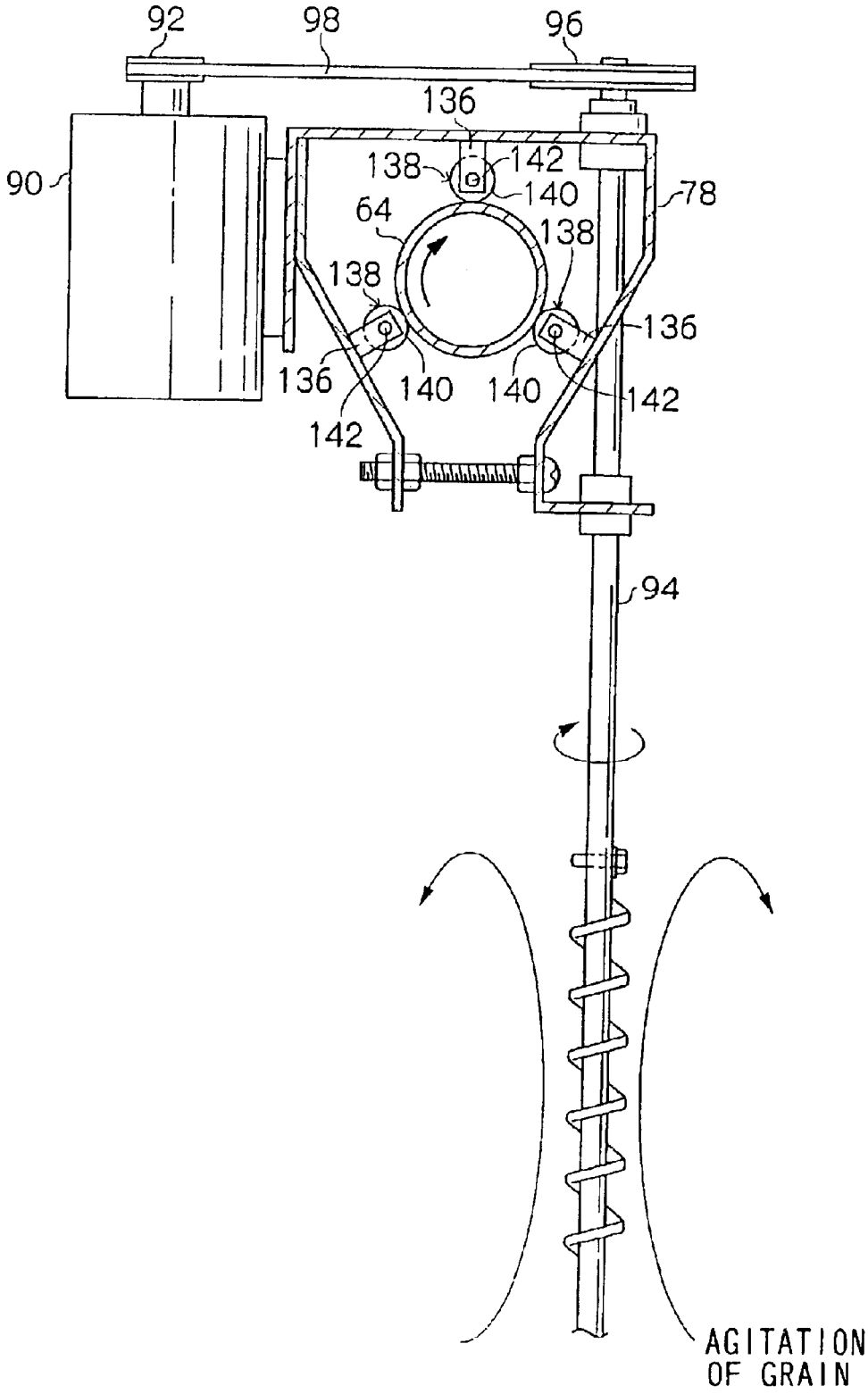
FIG. 6 is a partly broken side elevational view which shows a fixed support machine casing of the agitating machine according to the first embodiment of the invention.

A fixed support machine casing 78 formed in a substantially pentagonal tube shape is provided near the another end (at the one end side from the recess portion 66) of the guide shaft 64 in a state in which the fixed support machine casing 78 surrounds the guide shaft 64. As shown in FIG. 6, a plurality of plate-like support legs 136 are fixed to an inner surface of the fixed support machine casing 78. The plurality of support legs 136 are arranged in a peripheral direction within the fixed support machine casing 78 at a uniform interval (at an upper portion and both oblique lower portions within the fixed support machine casing 78 in the present embodiment). A rotating roll 138 (a ball bearing) is provided at a leading end of each of the support legs 136. Each of the rotating rolls 138 has a rotating wheel 140 formed in a substantially columnar shape, and a center shaft 142 formed in a columnar shape. Each of the center shafts 142 is supported by a leading end of each of the support legs 136. Each of the center shafts 142 is arranged in parallel to the axial direction of the guide shaft 64. Each of the center shafts 142 is fitted into a center of each of the rotating wheels 140. Each of the rotating wheels 140 is brought into contact with the peripheral surface of the guide shaft 64 at a position with a uniform interval in the peripheral direction, whereby the fixed support machine casing 78 is supported by the guide shaft 64.

Figure 7:
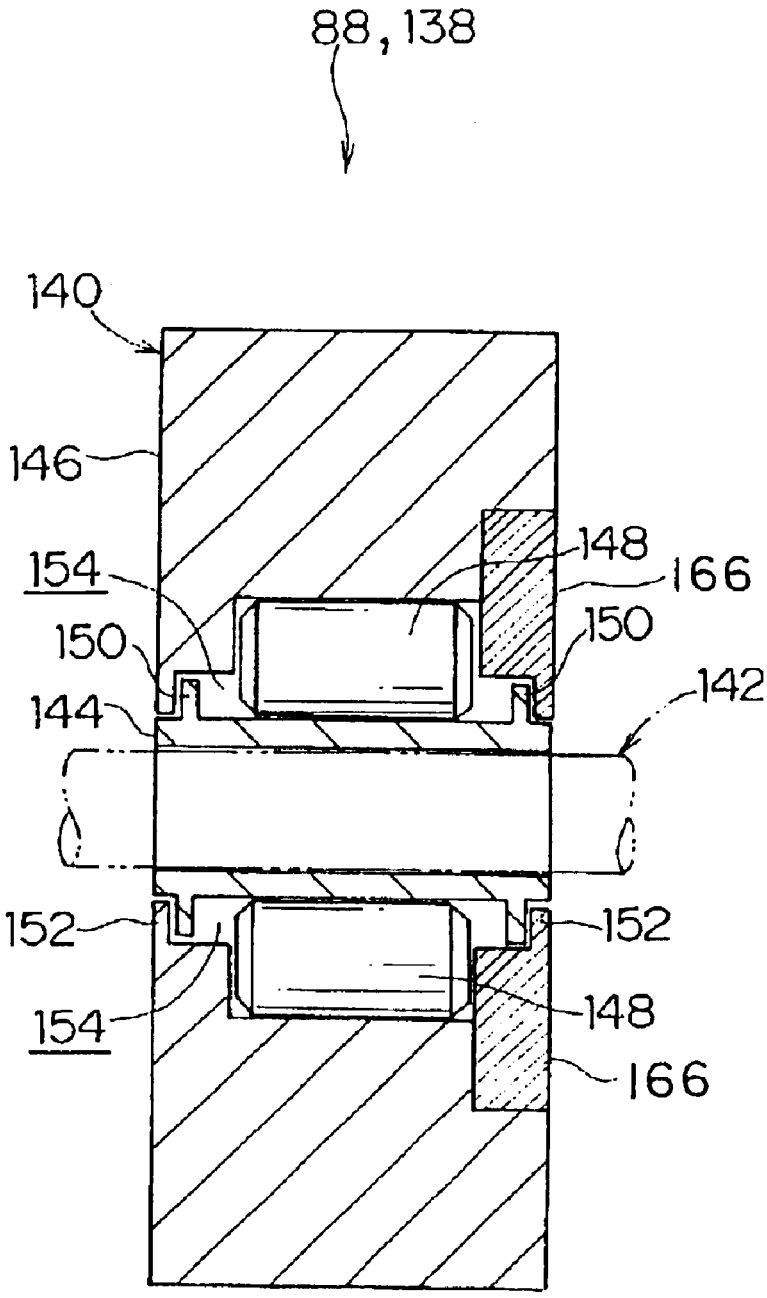
FIG. 7 is a cross sectional view which in detail shows a drive roll and a rotating roll in the agitating machine according to the first embodiment of the invention.

As shown in FIG. 7, a cylindrical inner tube 144 is provided at a center side portion of the rotating wheel 140. The center shaft 142 is fitted into the inner tube 144. A substantially columnar outer peripheral wheel 146 is provided at an outer peripheral side portion of the rotating wheel 140. A center portion of the outer peripheral wheel 146 is formed in a columnar hollow shape. A predetermined number of columnar rotating portions 148 are rotatably held at an inner periphery of the outer peripheral wheel 146. Each of the rotating portion 148 is in contact with an outer peripheral surface of the inner tube 144. Accordingly, each of the rotating portions 148 is rotated (revolved while being rotated on its own axis), the rotating wheel 140 (the rotating roll 138) is made rotatable around the center shaft 142 while the rotation of the outer peripheral wheel 146 with respect to the inner tube 144 is assisted. Therefore, the fixed support machine casing 78 is made rotatable with respect to the guide shaft 64 by each of the rotating rolls 138, thereby allowing the guide shaft 64 to rotate on its own axis.

Disc-like inner ring plates 150 are integrally provided at both ends in an axial direction of the outer periphery of the inner tube 144. Each of the inner ring plates 150 extends up to a portion just near the inner periphery of the outer peripheral wheel 146. Disc-like outer ring plates 152 are integrally provided at both ends in an axial direction of the inner periphery of the outer peripheral wheel 146. Each of the outer ring plates 152 extends up to a portion just near the outer periphery of the inner tube 144. Each of the outer ring plates 152 has a small gap with respect to each of the inner ring plates 150. A seal member (not shown) made of felt or the like is interposed between each of the inner ring plates 150 and each of the outer peripheral wheels 146. The portion between each of the inner ring plates 150 and each of the outer peripheral wheels 146 is sealed by each of the seal members. Accordingly, the space in which each of the rotating portions 148 is arranged is formed as a sealed space 154 which is sealed by the inner tube 144, the outer peripheral wheel 146, a pair of inner ring plates 150, a pair of outer ring plates 152 and each of the seal member.

A periphery around the center portion at one side portion of the outer peripheral wheel 146 is formed as a press-in lid 166 having a predetermined thickness and a disc shape. The press-in lid 166 is pressed in the outer peripheral wheel 146. In this case, the press-in lid 166 is taken out from the outer peripheral wheel 146, whereby it is possible to insert the inner tube 144, the rotating portion 148 and the seal member into the hollow portion of the center portion of the outer peripheral wheel 146.

In this case, it is possible to employ a commercial sealed dustproof bearing as the rotating roll 138.

A drive support machine casing 82 formed in a substantially inverse pentagonal tube shape is provided at the guide shaft 64 in a state in which the drive support machine casing 82 surrounds the guide shaft 64. The drive support machine casing 82 is arranged between the reversing plate 74 and the reversing plate 76.

Figure 4:
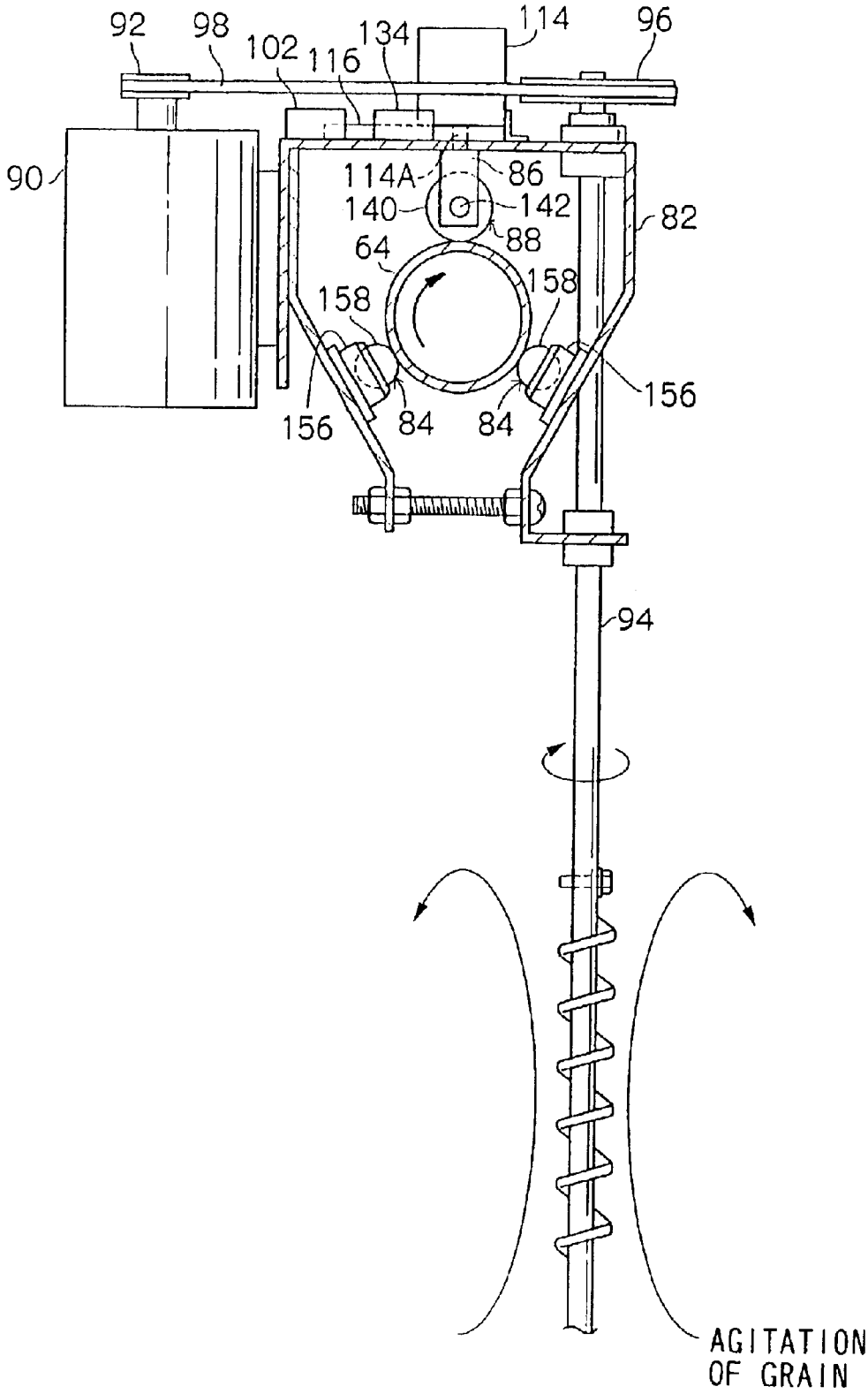
FIG. 4 is a partly broken side elevational view which shows the drive support machine casing of the agitating machine according to the first embodiment of the invention.

As shown in FIG. 4, a plurality of bearings 84 (free bearings) are provided at an inner surface of the drive support machine casing 82. Each of the bearings 84 has a holding pole 156 formed in a substantially columnar shape and a spherical rotating ball 158. Each of the holding pole 156 is fixed to an inner surface of the drive support machine casing 82. Each of the rotating balls 158 is rotatably held to each of the holding poles 156. A support frame 86 having an inverse U-shaped cross section is rotatably supported by an inner surface at an upper portion of the drive support machine casing 82. A drive roll 88 having the same structure as that of the rotating roll 138 is provided at an inner portion of the support frame 86.

The plurality of bearings 84 and the drive roll 88 are arranged at positions with a uniform interval in a peripheral direction within the drive support machine casing 82 (in the present embodiment, the bearings 84 are arranged at both oblique lower portions within the drive support machine casing 82 and the drive roll 88 is arranged at an upper portion within the drive support machine casing 82). The plurality of bearings 84 (the rotating balls 158) and the drive roll 88 (the rotating wheel 140) are in contact with the peripheral surface of the guide shaft 64 at the positions with uniform interval in the peripheral direction, whereby the drive support machine casing 82 is supported by the guide shaft 64. Accordingly, the drive support machine casing 82 is made rotatable with respect to the guide shaft 64 by each of the bearings 84 and the drive roll 88, and allows the guide shaft 64 to rotate on its own axis. Further, when the axial direction of the drive roll 88 (the center shaft 142) is inclined with respect to the axial direction of the guide shaft 64, the drive roll 88 rotates around the peripheral surface of the guide shaft 64, whereby the drive support machine casing 82 is moved in the axial direction of the guide shaft 64. Further, the peripheral surface of the drive roll 88 (the rotating wheel 140) is knurled.

Figure 5:
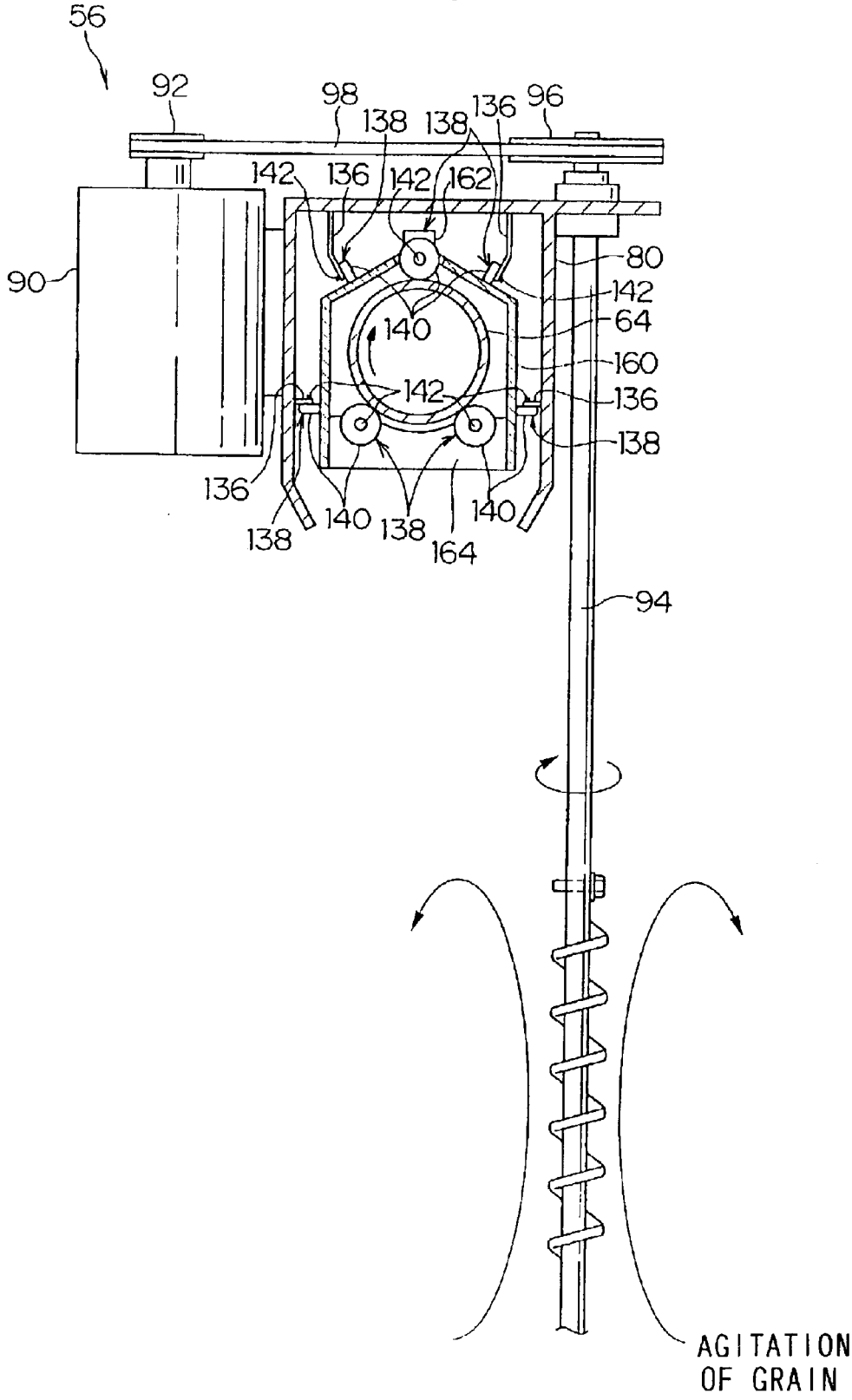
FIG. 5 is a partly broken side elevational view which shows a guide rail and a driven support machine casing of the agitating machine according to the first embodiment of the invention.

As shown in FIG. 5, a guide rail 160 formed in a substantially pentagonal tube shape is provided at the guide shaft 64 in a state in which the guide rail 160 surrounds the guide shaft 64. A lower surface of the guide rail 160 is open. The guide rail 160 is arranged between the fixed support machine casing 78 and the reversing plate 74 (refer to FIG. 8).

Figure 2:
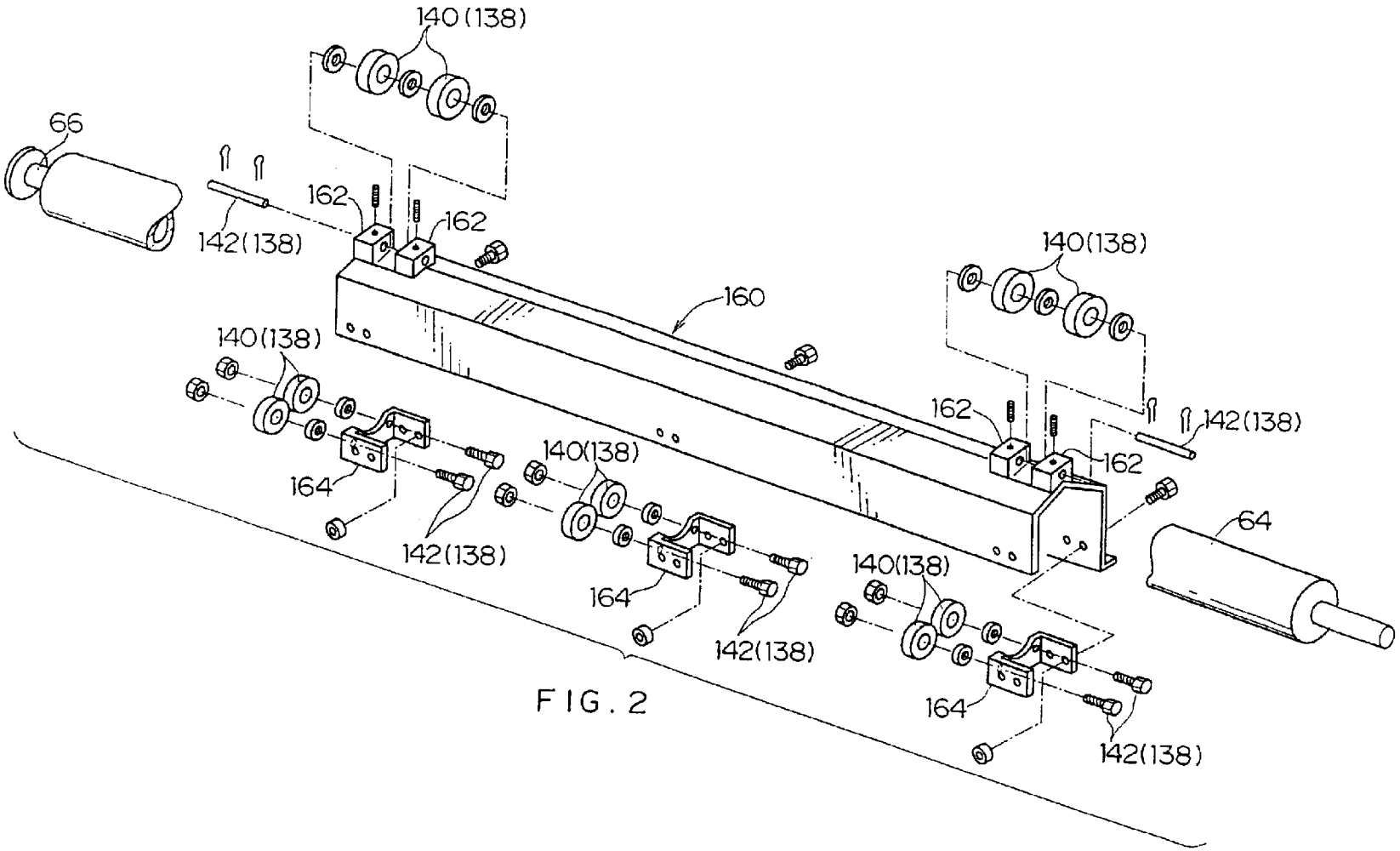
FIG. 2 is an exploded perspective view which shows a guide rail of the agitating machine according to the first embodiment of the invention.

As also shown in FIG. 2, a pair of support projections 162 are respectively provided at upper portions of both ends in a longitudinal direction of the guide rail 160. A pair of rotating rolls 138 having the same structure as described above and corresponding to first rolls are provided between the respective pairs of support projections 162. The center shaft 142 of each of the rotating rolls 138 is made parallel to the axial direction of the guide shaft 64. The rotating wheel 140 of each of the rotating rolls 138 protrudes within the guide rail 160, and is in contact with the peripheral surface of the guide shaft 64.

A support plate 164 is bridged between lower portions of side walls of the guide rail 160, at both ends and the center in the longitudinal direction thereof. The rotating rolls 138 having the same structure as described above and corresponding to the first rolls are provided at both ends of each of the support plates 164. The center shaft 142 of each of the rotating rolls 138 is made parallel to the axial direction of the guide shaft 64. The rotating wheel 140 of each of the rotating rolls 138 is in contact with the peripheral surface of the guide shaft 64.

As described above, each of the rotating rolls 138 of the guide rail 160 is brought into contact with the peripheral surface of the guide shaft 64, whereby the guide rail 160 is supported by the guide shaft 64. Accordingly, the guide rail 160 is made rotatable with respect to the guide shaft 64 by each of the rotating rolls 138, and allows the guide shaft 64 to rotate on its own axis.

A predetermined number (one in the present embodiment, however, normally one to three and the number is increased as the diameter of the peripheral wall 14 becomes large) of driven support machine casings 80 formed in substantially rectangular tube shapes and corresponding to moving members are provided at the guide rail 160 in a state in which the driven support machine casings 80 surround the guide rail 160. A lower surface of the driven support machine casing 80 is opened.

A plurality of support legs 136 having the same structure as described above are fixed to inner surfaces (inner surfaces of an upper wall and both side walls of the driven support machine casing 80 in the present embodiment) of the driven support machine casing 80. A rotating roll 138 having the same structure as described above and corresponding to a second roll is provided at a leading end of each of the support legs 136. The center shaft 142 of each of the rotating rolls 138 is made perpendicular to the axial direction of the guide shaft 64. The rotating wheel 140 of each of the rotating rolls 138 is in contact with the peripheral surface of the guide rail 160. Accordingly, the driven support machine casing 80 is supported by the guide rail 160. Therefore, the driven support machine casing 80 is allowed to move in a longitudinal direction of the guide rail 160 by each of the rotating rolls 138, and is allowed to move in the axial direction of the guide shaft 64.

As shown in FIGS. 4, 5 and 6, agitating motors 90 are provided at one side surfaces of the fixed support machine casing 78, the driven support machine casing 80 and the drive support machine casing 82. A drive pulley 92 is fixed to an output shaft of each of the agitating motors 90.

Upper portions of down augers 94 (screws) corresponding to agitating members are supported by another side portions of the fixed support machine casing 78, the driven support machine casing 80 and the drive support machine casing 82. A driven pulley 96 is fixed to an upper end of each of the down augers 94. A belt 98 is bridged between each of the drive pulleys 92 and each of the driven pulleys 96. Each of the agitating motors 90 is driven, whereby each of the down augers 94 is rotated on its own axis around the center axis via each of the drive pulleys 92, each of the belts 98 and each of the driven pulleys 96. Each of the down augers 94 is inserted into the rough rice M within the storing chamber 22. Accordingly, the rough rice M within the storing chamber 22 is agitated (mixed) due to an upward force.

Figure 1:
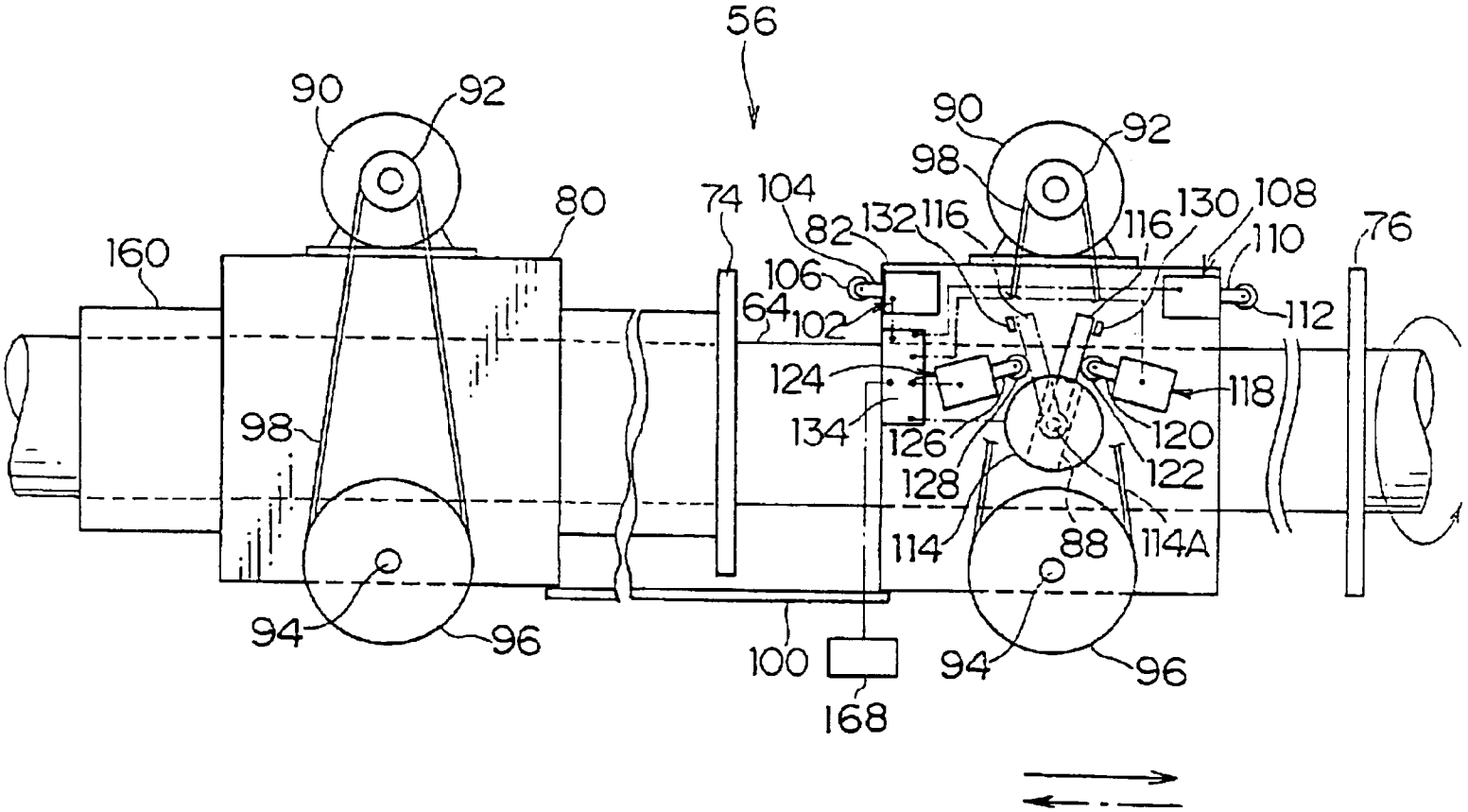
FIG. 1 is a plan view which shows a main portion of an agitating machine according to a first embodiment of the present invention.

As shown in FIG. 1, a connection lever 100 is fixed to a predetermined number of the driven support machine casings 80 and the drive support machine casing 82 by screws. Accordingly, a predetermined number of the driven support machine casings 80 and the driven support machine casing 82 are connected by the connection lever 100. Therefore, each of the driven support machine casings 80 and the drive support machine casing 82 are prevented from relatively moving in the axial direction of the guide shaft 64.

Figure 3:
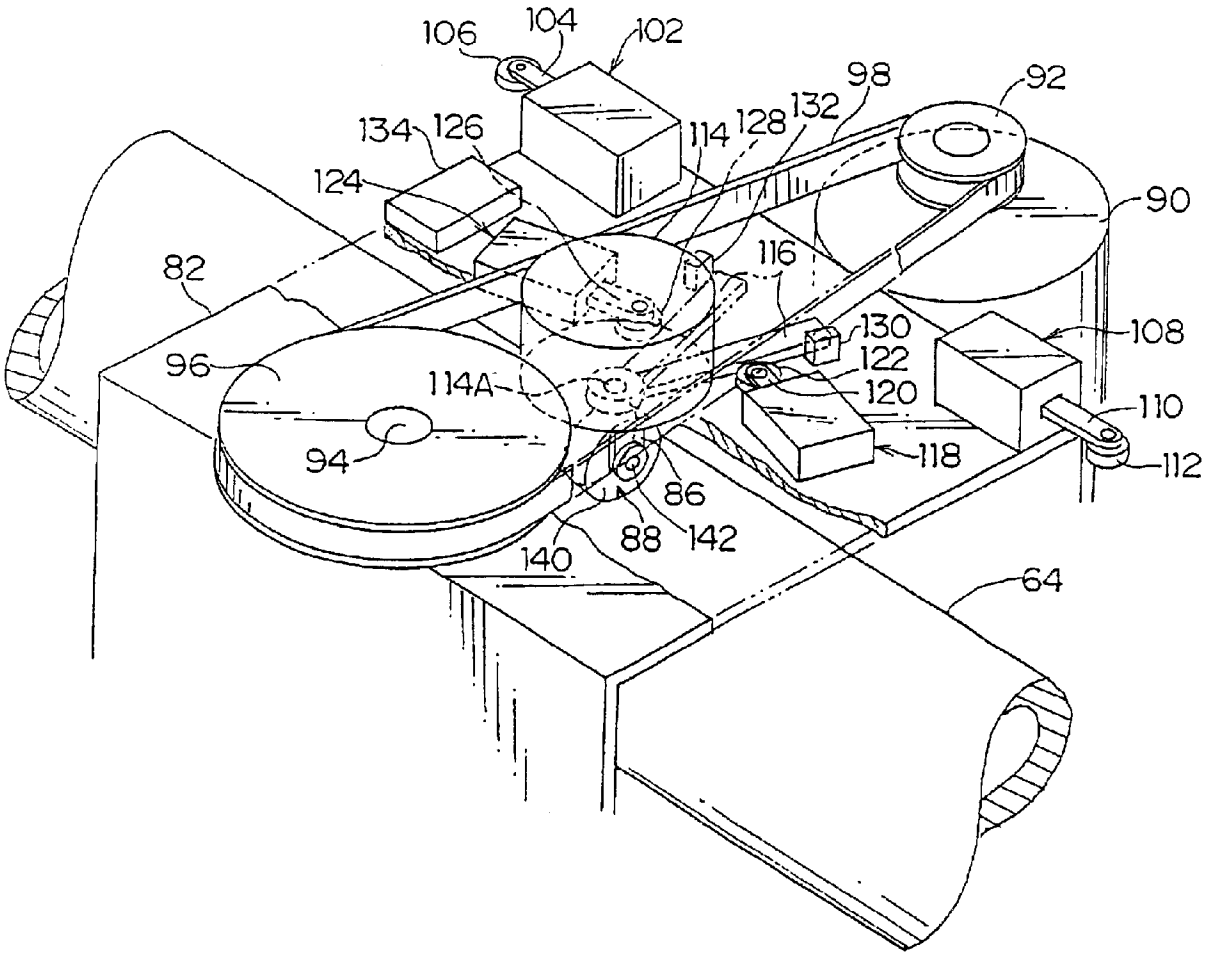
FIG. 3 is a perspective view which shows a drive support machine casing of the agitating machine according to the first embodiment of the invention.

As also shown in FIG. 3, an arrival detecting apparatus 102 (a limit switch) constituting the movement detecting component of the reversing component is fixed to an upper surface of an upper wall of the drive support machine casing 82, at a side end toward the reversing plate 74. A protruding portion 104 is provided at the arrival detecting apparatus 102. The protruding portion 104 protrudes to a side of the reversing plate 74 from the drive support machine casing 82. A columnar reversing roll 106 corresponding to a contact member is rotatably provided at a leading end of the protruding portion 104. The leading end (the reversing roll 106) of the protruding portion 104 is brought into contact with the reversing plate 74, whereby it is detected that the drive support machine casing 82 has reached the reversing plate 74 (that the drive roll 88 has been moved to the movement limit position at the another end side of the guide shaft 64).

An arrival detecting apparatus 108 (a limit switch) constituting the movement detecting component of the reversing component is fixed to an upper surface of the upper wall of the drive support machine casing 82, at a side end toward the reversing plate 76. A protruding portion 110 is provided at the arrival detecting apparatus 108. The protruding portion 110 protrudes to a side of the reversing plate 76 from the drive support machine casing 82. A columnar reversing roll 112 corresponding to the contact member is rotatably provided at a leading end of the protruding portion 110. The leading end (the reversing roll 112) of the protruding portion 110 is brought into contact with the reversing plate 76, whereby it is detected that the drive support machine casing 82 has reached the reversing plate 76 (that the drive roll 88 has been moved to the movement limit position at the one end side of the guide shaft 64).

A reversing motor 114 corresponding to an inclining component constituting the reversing component is fixed above the upper surface of the upper wall of the drive support machine casing 82. An output shaft 114A of the reversing motor 114 is inserted through the upper wall of the drive support machine casing 82 and is fixed to a center of the upper surface of the support frame 86 mentioned above (refer to FIG. 4). The reversing motor 114 is formed as a reversible geared motor. The reversing motor 114 is driven, whereby a direction of incline is changed in the axial direction of the drive roll 88 with respect to the axial direction of the guide shaft 64.

An oblong reversing lever 116 constituting the reversing component and an incline detecting component is provided at the upper surface of the upper wall of the drive support machine casing 82. A base end of the reversing lever 116 is fixed to the output shaft 114A of the reversing motor 114 (refer to FIG. 4). The reversing lever 116 is arranged perpendicularly with respect to the axial direction of the drive roll 88.

An incline detecting apparatus 118 (a limit switch) constituting the incline detecting component is fixed to the upper surface of the upper wall of the drive support machine casing 82, at a side of the reversing lever 116 toward the reversing plate 76. A projection portion 120 is provided at the incline detecting apparatus 118. The projection portion 120 protrudes to a side of the reversing lever 116. A columnar detecting roll 122 is rotatably provided at a leading end of the projection portion 120. The reversing lever 116 is rotated together with the drive roll 88 due to the driving of the reversing motor 114, and the reversing lever 116 is brought into contact with the leading end (the detecting roll 122) of the projection portion 120, whereby it is detected that the axial direction of the drive roll 88 is inclined to one side with respect to the axial direction of the guide shaft 64 (that the side of the drive roll 88 opposite to the rotation direction of the guide shaft 64 is inclined to the side of the reversing plate 76).

An incline detecting apparatus 124 (a limit switch) constituting the incline detecting component is fixed to the upper surface of the upper wall of the drive support machine casing 82, at a side of the reversing lever 116 toward the reversing plate 74. A projection portion 126 is provided at the incline detecting apparatus 124. The projection portion 126 protrudes to a side of the reversing lever 116. A columnar detecting roll 128 is rotatably provided at a leading end of the projection portion 126. The reversing lever 116 is rotated together with the drive roll 88 due to the driving of the reversing motor 114, and the reversing lever 116 is brought into contact with the leading end (the detecting roll 128) of the projection portion 126, whereby it is detected that the axial direction of the drive roll 88 is inclined to another side with respect to the axial direction of the guide shaft 64 (that the side of the drive roll 88 opposite to the rotation direction of the guide shaft 64 is inclined to the side of the reversing plate 74).

Rectangular pole shaped stoppers 130 and 132 constituting the reversing component are fixed to the upper surface of the upper wall of the drive support machine casing 82, respectively at a side of the reversing plate 76 and at a side of the reversing plate 74 with respect to the leading end of the reversing lever 116. The reversing lever 116 is rotated together with the drive roll 88 due to the driving of the reversing motor 114, and the leading end of the reversing lever 116 is brought into contact with the stopper 130 or the stopper 132, whereby the rotation of the reversing lever 116 is limited, an angle of incline to the one side or the another side is limited in the axial direction of the drive roll 88 with respect to the axial direction of the guide shaft 64.

A control apparatus 134 constituting the reversing component is fixed to the upper surface of the upper wall of the drive support machine casing 82. The arrival detecting apparatuses 102 and 108, the reversing motor 114 and the incline detecting apparatuses 118 and 124 are connected to the control apparatus 134.

In this case, the reversing motor 114 is driven by the control apparatus 134 and the leading end of the reversing lever 116 is brought into contact with the stopper 130, whereby the axial direction of the drive roll 88 is inclined to the one side with respect to the axial direction of the guide shaft 64. Accordingly, the drive roll 88 is rotated around the peripheral surface of the guide shaft 64 which is rotated on its own axis, whereby the drive support machine casing 82 and the driven support machine casing 80 are moved to the one end side (the side of the reversing plate 76) of the guide shaft 64.

Thereafter, when it is detected by the arrival detecting apparatus 108 that the drive support machine casing 82 has reached the reversing plate 76, the reversing motor 114 is driven by the control apparatus 134 and the leading end of the reversing lever 116 is brought into contact with the stopper 132, whereby the axial direction of the drive roll 88 is inclined to the another side with respect to the axial direction of the guide shaft 64. Accordingly, the drive roll 88 is rotated around the peripheral surface of the guide shaft 64 which is rotated on its own axis, whereby the drive support machine casing 82 and the driven support machine casing 80 are moved to the another end side (the side of the fixed support machine casing 78) of the guide shaft 64.

Further, when it is detected by the arrival detecting apparatus 102 that the drive support machine casing 82 has reached the reversing plate 74, the reversing motor 114 is driven by the control apparatus 134, whereby the leading end of the reversing lever 116 is again brought into contact with the stopper 130 and the axial direction of the drive roll 88 is inclined to the one side with respect to the axial direction of the guide shaft 64. Accordingly, the drive support machine casing 82 and the driven support machine casing 80 are moved to the one end side of the guide shaft 64.

Accordingly, the movement of the drive support machine casing 82 and the driven support machine casing 80 to the one end side of the guide shaft 64 is reversed when the drive support machine casing 82 has reached the reversing plate 76. Further, the movement of the drive support machine casing 82 and the driven support machine casing 80 to the another end side of the guide shaft 64 is reversed when the drive support machine casing 82 has reached the reversing plate 74. Therefore, the drive support machine casing 82 is oscillated between the reversing plate 74 and the reversing plate 76. Further, the driven support machine casing 80 is oscillated on the guide rail 160 between the fixed support machine casing 78 and the reversing plate 74.

Therefore, each of the down augers 94 which are provided at the drive support machine casing 82, the driven support machine casing 80 and the fixed support machine casing 78 is revolved together with the guide shaft 64. Further, each of the down augers 94 which are provided at the drive support machine casing 82 and the driven support machine casing 80 is oscillated in the axial direction of the guide shaft 64. Accordingly, the structure is made such that the rough rice M within the storing chamber 22 is uniformly agitated.

The rotating motor 62, the respective agitating motors 90 and the dry wind generating apparatus 46 are connected to the control apparatus 134. In the case when a state in which the incline detecting apparatus 118 does not detect the incline of the axial direction of the drive roll 88 to the one side with respect to the axial direction of the guide shaft 64 (the contact of the reversing lever 116 with the leading end of the projection portion 120), and the incline detecting apparatus 124 does not detect the incline of the axial direction of the drive roll 88 to the another side with respect to the axial direction of the guide shaft 64 (the contact of the reversing lever 116 with the leading end of the projection portion 126) continues for more than a predetermined amount of time (an amount of time required for the direction of incline of the axial direction of the drive roll 88 with respect to the axial direction of the guide shaft 64 to be changed from one side and another side due to the driving of the rotating motor 62) (for example, in a case when the reversing lever 116 stops between the incline detecting apparatus 118 and the incline detecting apparatus 124, hereinafter, referred to as "in a case when the incline of the drive roll 88 with respect to the guide shaft 64 is defective"), the driving of the rotating motor 62, each of the agitating motors 90 and the dry wind generating apparatus 46 is stopped by the control apparatus 134, and the operation is all stopped.

A warning apparatus 168 is connected to the control apparatus 134. The structure is made such that the warning apparatus 168 gives a warning in the case when the incline of the drive roll 88 with respect to the guide shaft 64 is defective.

Next, a description will be given of an operation of the present embodiment.

In the accumulating, agitating, mixing, drying and storing apparatus 10 having the structure mentioned above, the rough rice M is stored in the storing chamber 22 within the grain tank 12. The dry wind generating apparatus 46 blows the dry wind into the storing chamber 22, whereby the rough rice M within the storing chamber 22 is exposed to the dry wind and dried.

The agitating machine 56 is provided within the grain tank 12. The guide shaft 64 of the agitating machine 56 is rotates on its own axis around the center axis. Further, the guide shaft 64 is revolved around the one end side thereof within the grain tank 12. Further, the drive roll 88 of the drive support machine casing 82 is in contact with the peripheral surface of the guide shaft 64. The drive support machine casing 82 and the driven support machine casing 80 are integrally moved with the drive roll 88.

In this case, when the axial direction of the drive roll 88 is inclined to the one side with respect to the axial direction of the guide shaft 64 (when the side of the drive roll 88 opposite to the rotation direction of the guide shaft 64 is inclined to the side of the reversing plate 76), the drive roll 88 is rotated around the peripheral surface of the guide shaft 64, whereby the drive roll 88 is moved to the one end side (the side of the reversing plate 76) of the guide shaft 64.

On the contrary, when the axial direction of the drive roll 88 is inclined to the another side with respect to the axial direction of the guide shaft 64 (the side of the drive roll 88 opposite to the rotation direction of the guide shaft 64 is inclined to the side of the reversing plate 74), the drive roll 88 is rotated around the peripheral surface of the guide shaft 64, whereby the drive roll 88 is moved to the another end side (the side of the reversing plate 74) of the guide shaft 64.

Further, when the arrival detecting apparatus 108 detects that the drive support machine casing 82 has reached the reversing plate 76 (that the drive roll 88 has been moved to the movement limit position at the one end side of the guide shaft 64), the control apparatus 134 drives the reversing motor 114 so as to incline the axial direction of the drive roll 88 to the another side with respect to the axial direction of the guide shaft 64. Accordingly, the drive roll 88 is moved to the another end side of the guide shaft 64.

On the other hand, when the arrival detecting apparatus 102 detects that the drive support machine casing 82 has reached the reversing plate 74 (that the drive roll 88 has been moved to the movement limit position at the another end side of the guide shaft 64), the control apparatus 134 drives the reversing motor 114 so as to incline the axial direction of the drive roll 88 to the one side with respect to the axial direction of the guide shaft 64. Accordingly, the drive roll 88 is moved to the one end side of the guide shaft 64.

Accordingly, the drive support machine casing 82 and the driven support machine casing 80 are oscillated along the guide shaft 64 (the drive roll 88 is oscillated between the movement limit position at the one end side of the guide shaft 64 and the movement limit position at the another end side of the guide shaft 64). Therefore, each of the down augers 94 of the drive support machine casing 82 and the driven support machine casing 80 is not only revolved with the guide shaft 64 in a state in which the down augers 94 are inserted into the rough rice M, but also rotated on its own axis around the center axis as well as being oscillated along the guide shaft 64 integrally with the drive roll 88. Accordingly, each of the down augers 94 of the drive support machine casing 82 and the driven support machine casing 80 agitate the rough rice M.

In this case, the arrival detecting apparatuses 102 and 108, the reversing motor 114 and the control apparatus 134 are electrically driven. Accordingly, when the drive roll 88 has been moved to the movement limit position at the one end side of the guide shaft 64, the axial direction of the drive roll 88 is securely inclined to the another side with respect to the axial direction of the guide shaft 64. Further, when the drive roll 88 has been moved to the movement limit position at the another end side of the guide shaft 64, the axial direction of the drive roll 88 is securely inclined to the one side with respect to the axial direction of the guide shaft 64. Accordingly, it is possible to securely incline the axial direction of the drive roll 88 with respect to the axial direction of the guide shaft 64. Therefore, the drive roll 88 can securely oscillate the guide shaft 64.

Accordingly, it is possible to prevent each of the down augers 94 of the drive support machine casing 82 and the driven support machine casing 80 from agitating only the rough rice M in the fixed portion within the grain tank 12, and it is possible to securely agitate the rough rice M within the grain tank 12 uniformly. Therefore, it is possible to prevent the dry spot from being generated in the rough rice M. Thus, it is possible to prevent the quality deterioration trouble from being generated in the rough rice M, and it is possible to finish the high quality rough rice M.

Further, it is possible to prevent the drive roll 88 from rotating only the fixed portion of the peripheral surface of the guide shaft 64 and it is possible to prevent the peripheral surface of the guide shaft 64 from being locally abraded (recessed). Accordingly, it is possible to prevent the guide shaft 64 from being ineffective for repair.

Further, the arrival detecting apparatuses 102 and 108, the reversing motor 114 and the control apparatus 134 are electrically driven in the manner mentioned above. Accordingly, it is possible to simplify the mechanism of changing the direction of incline of the drive roll 88 with respect to the axial direction of the guide shaft 64. Therefore, it is possible to intend to achieve a cost saving.

Further, if the drive roll 88 becomes defective in incline with respect to the guide shaft 64 (in particular, if the axial direction of the drive roll 88 becomes parallel to the axial direction of the guide shaft 64), the driving of the rotating motor 62, each of the agitating motors 90 and the dry wind generating apparatus 46 is stopped by the control apparatus 134, and the operation is all stopped. Further, at this time, the warning apparatus 168 is driven by the control apparatus 134, and the warning is given. Accordingly, it is informed to the operator or the like that the drive roll 88 becomes defective in incline with respect to the guide shaft 64.

Accordingly, it is possible to previously prevent the dry spot from being generated in the rough rice M. Further, it is possible to securely prevent the drive roll 88 from rotating only the fixed portion of the peripheral surface of the guide shaft 64 and it is possible to securely prevent the peripheral surface of the guide shaft 64 from being locally abraded (recessed). Therefore, it is possible to securely prevent the guide shaft 64 from being ineffective for repair.

Further, the fact that the drive roll 88 becomes defective in incline with respect to the guide shaft 64 and the dry wind is not blown into the grain tank 12 is instantaneously informed to the operator or the like by using the warning mentioned above. Accordingly, it is possible to prevent the rough rice M from being left within the grain tank 12 to which the dry wind is not blown, for a long time. Therefore, it is possible to prevent the rough rice M from being ripe.

In this case, the rotating rolls 138 of the guide rail 160 are in contact with the guide shaft 64, and the guide rail 160 is supported by the guide shaft 64. The rotating rolls 138 of the guide rail 160 are made rotatable around the center shafts 142 in the direction parallel to the axial direction of the guide shaft 64. Accordingly, the guide rail 160 allows the guide shaft 64 to rotate on its own axis. Further, the rotating rolls 138 of the driven support machine casing 80 are in contact with the guide rail 160, and the driven support machine casing 80 is supported by the guide rail 160. The rotating rolls 138 of the driven support machine casing 80 are made rotatable around the center shafts 142 in the direction perpendicular to the axial direction of the guide shaft 64. Accordingly, the driven support machine casing 80 is allowed to move in the axial direction of the guide shaft 64.

Further, the rotating rolls 138 of the fixed support machine casing 78 are in contact with the guide shaft 64, and the fixed support machine casing 78 is supported by the guide shaft 64. The rotating rolls 138 of the fixed support machine casing 78 are made rotatable around the center shafts 142 in the direction parallel to the axial direction of the guide shaft 64. Accordingly, the fixed support machine casing 78 allows the guide shaft 64 to rotate on its own axis.

In this case, each of the drive roll 88 of the drive support machine casing 82 and the rotating rolls 138 of the guide rail 160, the driven support machine casing 80 and the fixed support machine casing 78 is structured such as to be rotatable around the fixed center shaft 142. Accordingly, the drive roll 88 and the rotating rolls 138 can be formed as a sealed type dustproof structure in which the rotating performance thereof is hard to be deteriorated due to the dust generated by the dried rough rice M within the grain tank 12. Therefore, it is possible to extend a service life of the drive roll 88 and the rotating rolls 138, and it is possible to extend a period until the maintenance of the agitating machine 56 is required.

Further, in each of the rotating wheels 140 of the drive roll 88 and the rotating rolls 138, the rotating portions 148 arranged at the sealed space 154 between the inner tube 144 and the outer peripheral wheel 146 are rotated, whereby the rotation of the outer peripheral wheel 146 with respect to the inner tube 144 is assisted. Accordingly, it is possible to smoothly rotate the drive roll 88 and the rotating rolls 138.

Further, in the sealed space 154, the periphery is sealed by the inner tube 144, the outer peripheral wheel 146, a pair of inner ring plates 150 of the inner tube 144, a pair of outer ring plates 152 of the outer peripheral wheel 146 and each of the seal members. Accordingly, it is possible to prevent or suppress the rotating performance of the rotating portions 148 arranged at the sealed space 154 from being deteriorated by the dust or the like. Therefore, the drive roll 88 and the rotating rolls 138 can be securely formed in the sealed type dustproof structure in which the rotating performance is hard to be deteriorated by the dust or the like.

(Second Embodiment)

Figure 13:
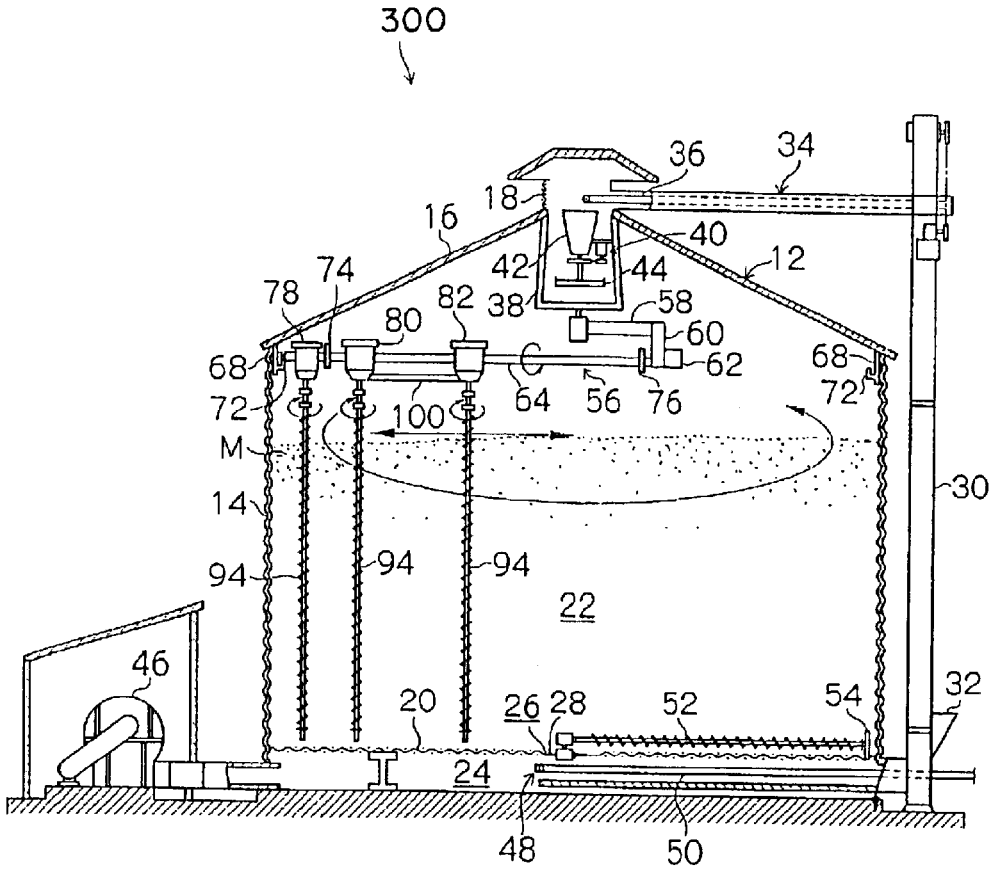
FIG. 13 is a vertical cross sectional view which shows an accumulating, agitating, mixing, drying and storing apparatus according to the second embodiment of the invention.

FIG. 13 is a vertical cross sectional view of an accumulating, agitating, mixing, drying and storing apparatus 300 corresponding to a grain storing apparatus according to a second embodiment to which the grain agitating apparatus of the invention is applied.

The accumulating, agitating, mixing, drying and storing apparatus 300 according to the present embodiment has substantially the same structure as the accumulating, agitating, mixing, drying and storing apparatus 10 according to the first embodiment mentioned above. However, the accumulating, agitating, mixing, drying and storing apparatus 300 is different from the accumulating, agitating, mixing, drying and storing apparatus 10 in the following points.

In the agitating machine 56, the reversing plate 74 is fixed to the portion near the another end of the guide shaft 64 (at the side toward the one end from the recess portion 66). Further, the fixed support machine casing 78 is arranged at the another end side of the guide shaft 64 from the reversing plate 74. Further, the driven support machine casing 80 and the drive support machine casing 82 are arranged between the reversing plate 74 and the reversing plate 76.

The guide rail 160 (including the support projections 162, the support plates 164 and the rotating rolls 138 provided between the support projections 162 and at the support plates 164) is not provided at the guide shaft 64. The driven support machine casing 80 is provided at the guide shaft 64 in a state in which the driven support machine casing 80 directly surrounds the guide shaft 64.

Figure 12:
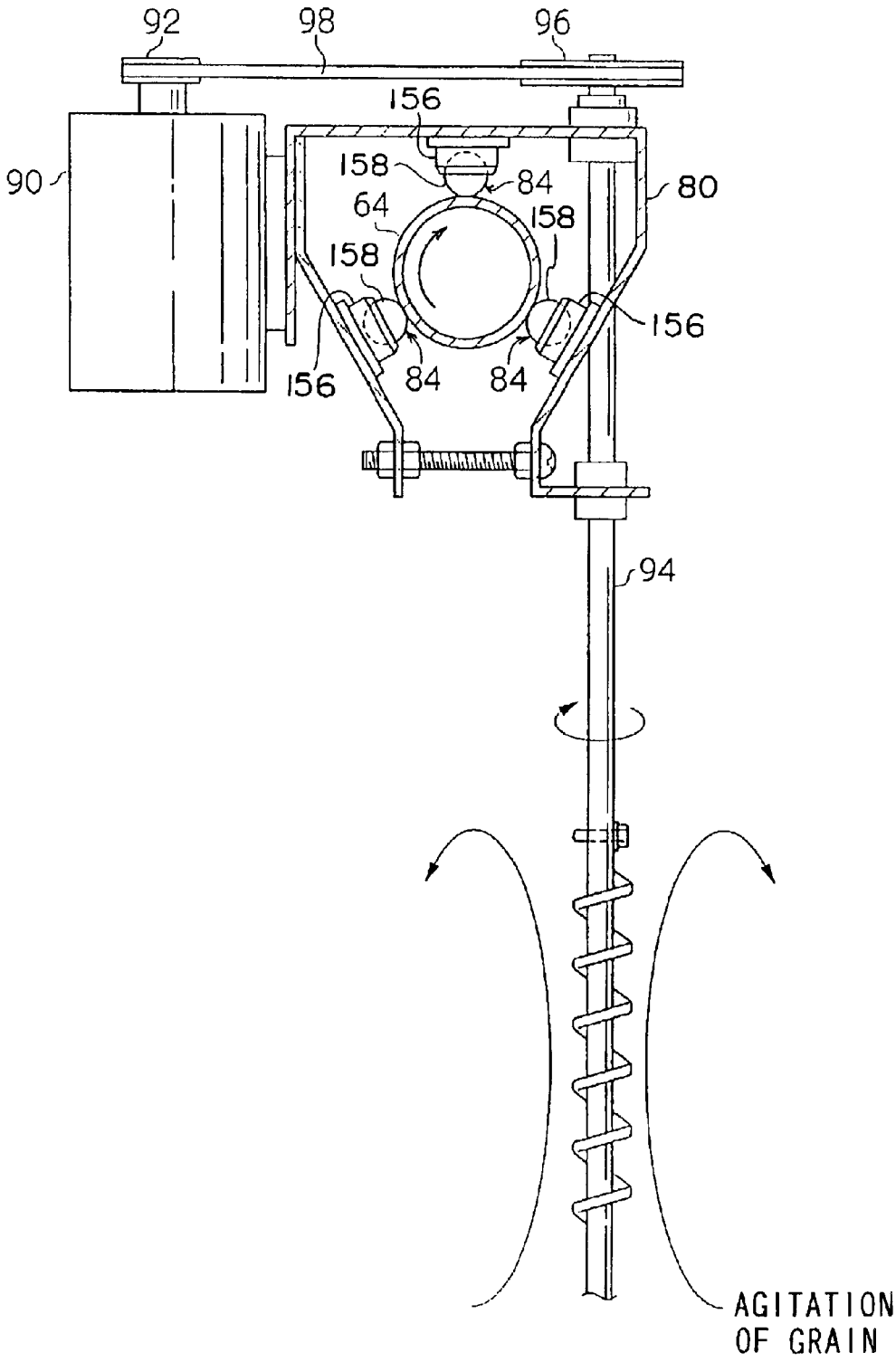
FIG. 12 is a partly broken side elevational view which shows a driven support machine casing of the agitating machine according to the second embodiment of the invention.

As shown in FIG. 12, the driven support machine casing 80 is formed in a substantially inverted pentagonal tube shape. The support legs 136 and the rotating rolls 138 according to the first embodiment are not provided at the inner surface of the driven support machine casing 80. A plurality of bearings 84 (including the holding poles 156 and the rotating balls 158) having the same structure as the first embodiment are provided at the inner surface of the driven support machine casing 80. The plurality of bearings 84 are arranged in the peripheral direction within the driven support machine casing 80 with a uniform interval (in the present embodiment, at the upper portion and both oblique lower portions within the driven support machine casing 80). Each of the bearings 84 (each of the rotating balls 158) is in contact with the peripheral surface of the guide shaft 64 at each of the positions having the uniform interval in the peripheral direction, whereby the driven support machine casing 80 is supported by the guide shaft 64. Accordingly, the driven support machine casing 80 is made rotatable with respect to the guide shaft 64 by each of the bearings 84. Therefore, the driven support machine casing 80 allows the guide shaft 64 to rotate on its own axis. Further, the driven support machine casing 80 is made movable in the axial direction of the guide shaft 64.

Figure 10:
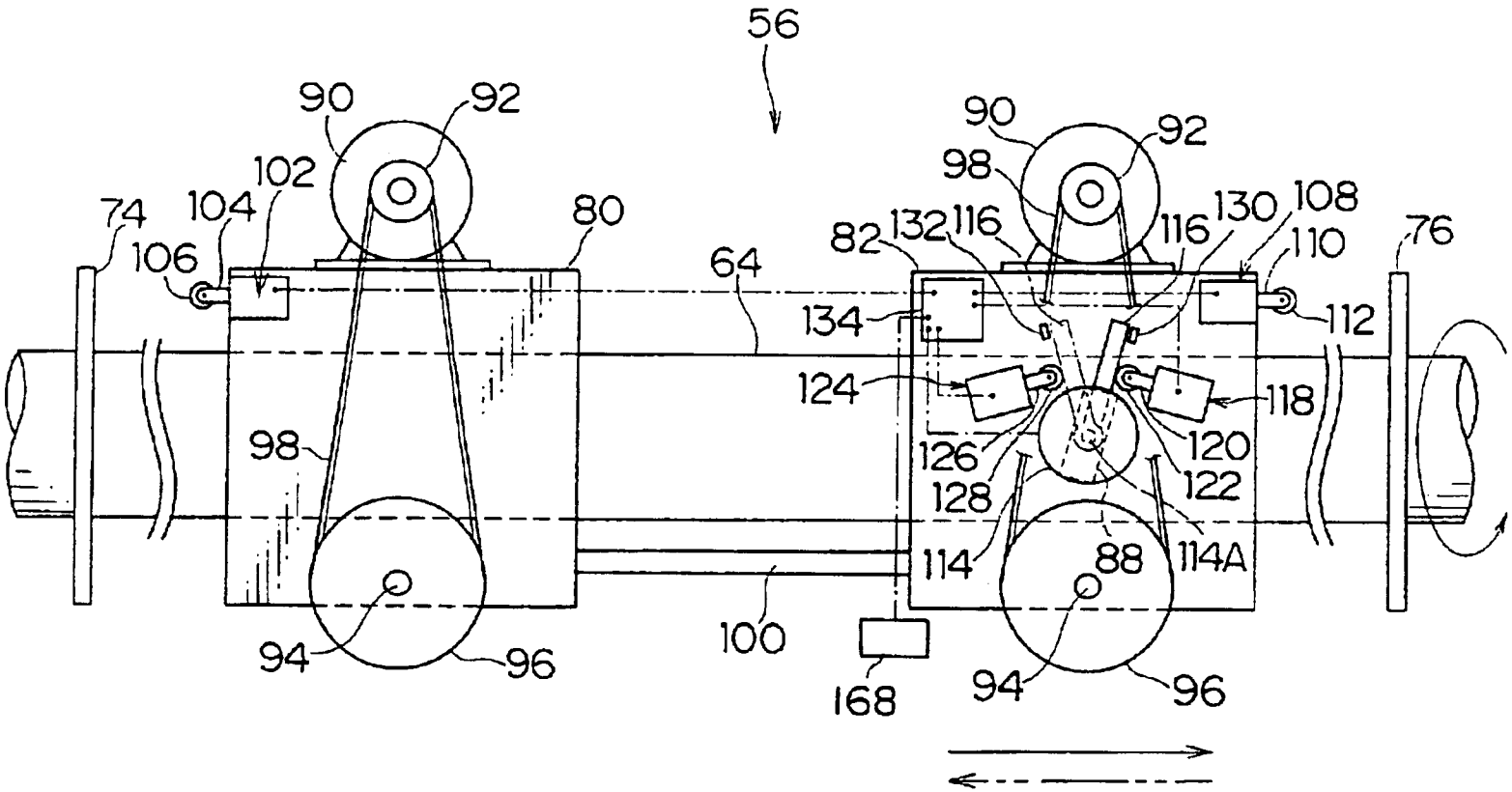
FIG. 10 is a plan view which shows a main portion of an agitating machine according to a second embodiment of the invention.
Figure 11:
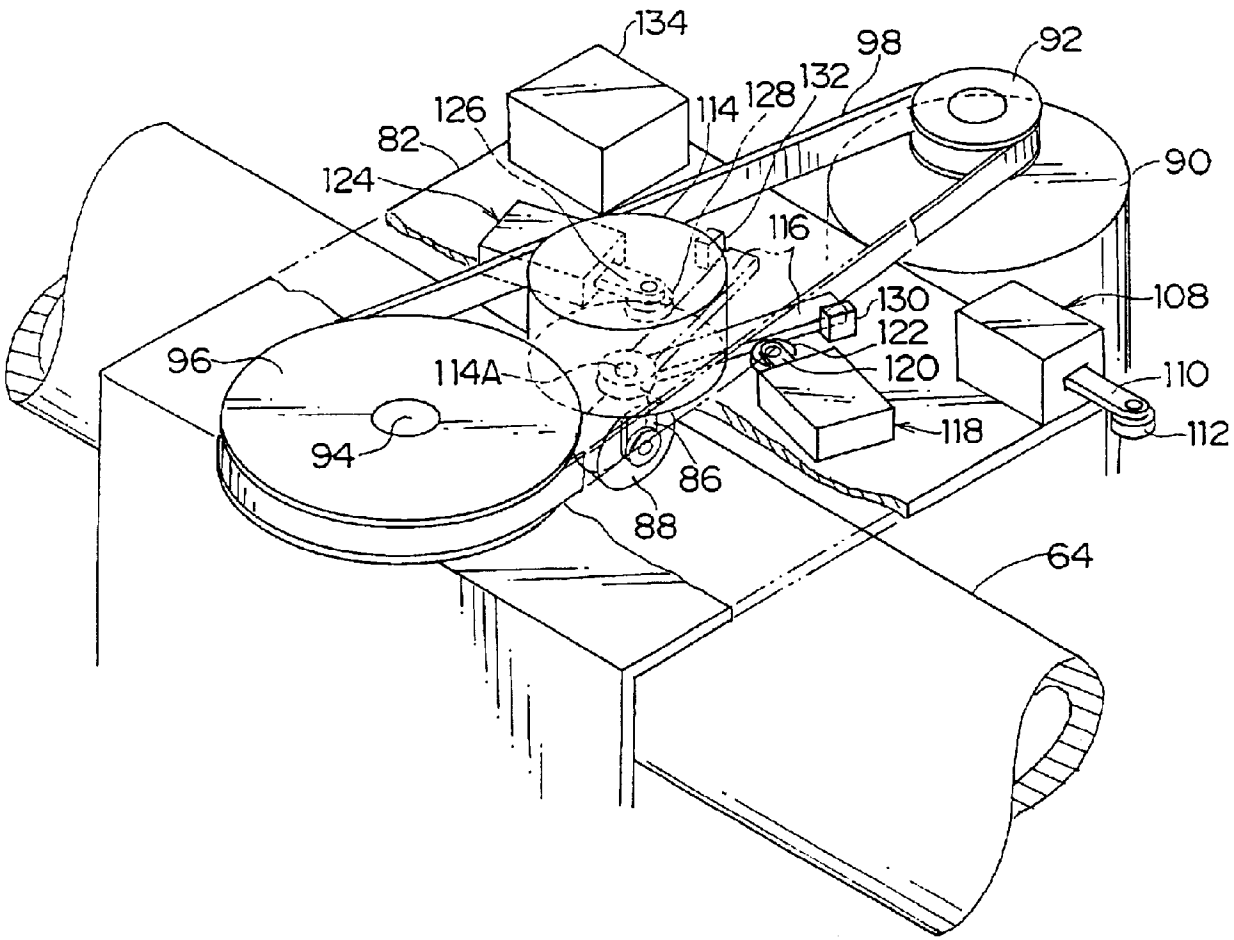
FIG. 11 is a perspective view which shows a drive support machine casing of the agitating machine according to the second embodiment of the invention.

As shown in FIGS. 10 and 11, the arrival detecting apparatus 102 is not fixed to the upper surface of the upper wall of the drive support machine casing 82. The arrival detecting apparatus 102 is fixed to the upper surface of the upper wall of the driven support machine casing 80. The protruding portion 104 of the arrival detecting apparatus 102 protrudes to the side of the reversing plate 74 from the driven support machine casing 80. The leading end (the reversing roll 106) of the protruding portion 104 is in contact with the reversing plate 74, whereby it is detected that the driven support machine casing 80 has reached the reversing plate 74 (that the drive roll 88 has been moved to the movement limit position at the another end side of the guide shaft 64).

When it is detected by the arrival detecting apparatus 102 that the driven support machine casing 80 has reached the reversing plate 74, the reversing motor 114 is driven by the control apparatus 134, whereby the leading end of the reversing lever 116 is brought into contact with the stopper 130, and the axial direction of the drive roll 88 is inclined to the one side with respect to the axial direction of the guide shaft 64. Accordingly, the drive support machine casing 82 and the driven support machine casing 80 are moved to the one end side of the guide shaft 64 (the side of the reversing plate 76).

Accordingly, the movement of the drive support machine casing 82 and the driven support machine casing 80 to the one end side of the guide shaft 64 is reversed when the drive support machine casing 82 has reached the reversing plate 76. Further, the movement of the drive support machine casing 82 and the driven support machine casing 80 to the another end side of the guide shaft 64 is reversed when the driven support machine casing 80 has reached the reversing plate 74. Therefore, the structure is made such that the drive support machine casing 82 and the driven support machine casing 80 are oscillated between the reversing plate 74 and the reversing plate 76.

In this case, according to the present embodiment, it is possible to obtain the same effects as the effects obtained by the first embodiment mentioned above, except the effect obtained by the guide rail 160 and the rotating rolls 138 of the driven support machine casing 80.

In this case, in the first embodiment and the second embodiment mentioned above, the structure is made such that the arrival detecting apparatus 102 is provided on the upper surface of the upper wall of the drive support machine casing 82 or the driven support machine casing 80. Further, the structure is made such that the arrival detecting apparatus 108, the reversing lever 116, the incline detecting apparatuses 118 and 124, the stoppers 130 and 132, and the control apparatus 134 are provided on the upper surface of the upper wall of the drive support machine casing 82. However, the structure may be made such that the arrival detecting apparatus and the control apparatus are provided on the lower surface of the upper wall of the driven support machine casing or the drive support machine casing. Further, the structure may be made such that the reversing lever, the incline detecting apparatus and the stoppers are provided on the lower surface of the upper wall of the drive support machine casing.

(Third Embodiment)

Figure 16:
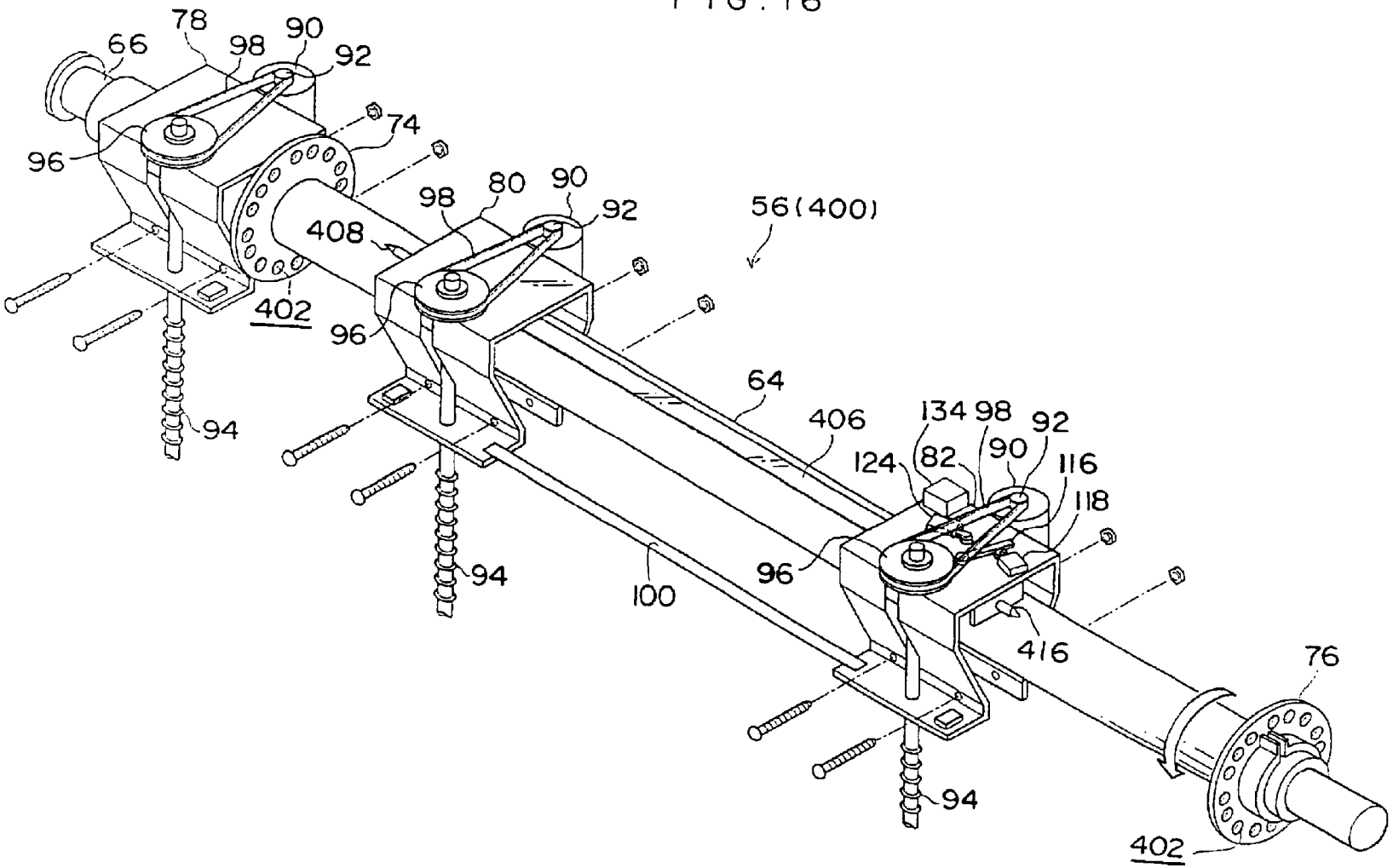
FIG. 16 is a perspective view which shows the agitating machine according to the third embodiment of the invention.

FIG. 16 is a perspective view of an accumulating, agitating, mixing, drying and storing apparatus 400 corresponding to a grain storing apparatus according to a third embodiment to which the grain agitating apparatus of the invention is applied.

The accumulating, agitating, mixing, drying and storing apparatus 400 according to the present embodiment has substantially the same structure as the accumulating, agitating, mixing, drying and storing apparatus 300 according to the second embodiment mentioned above. However, the accumulating, agitating, mixing, drying and storing apparatus 400 is different from the accumulating, agitating, mixing, drying and storing apparatus 300 in the following points.

In the agitating machine 56, a plurality of oblong holes 402 are formed at the peripheral portions of the reversing plates 74 and 76. The plurality of oblong holes 402 are arranged in the peripheral direction of the reversing plates 74 and 76 with a uniform interval.

Figure 15A:
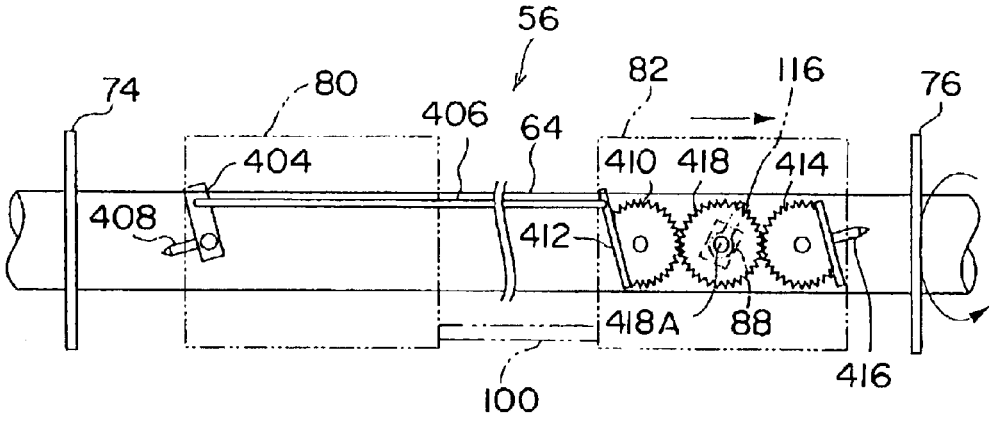
Figure 15B:
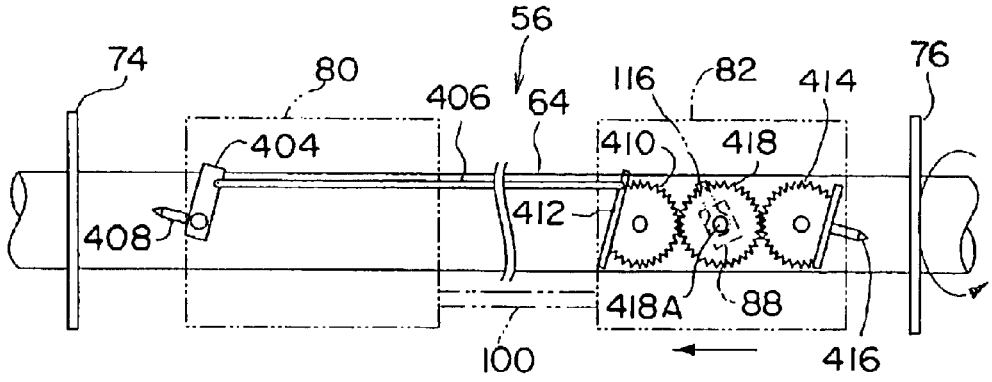

As shown in FIGS. 15A and 15B, one end of a reversing arm 404 constituting the reversing component is rotatably supported by the lower surface of the upper wall of the driven support machine casing 80, at a side end toward the reversing plate 74. One end of a reversing rod 406 constituting the reversing component is rotatably connected to another end of the reversing arm 404. A reversing pin 408 constituting the reversing component is fixed to the one end of the reversing arm 404. The reversing pin 408 protrudes to the side of the reversing plate 74 from the driven support machine casing 80.

A passive gear 410 constituting the reversing component is rotatably supported by the lower surface of the upper wall of the drive support machine casing 82, at the side end toward the reversing plate 74. A passive arm 412 constituting the reversing component is fixed to the passive gear 410. Another end of the reversing rod 406 is rotatably connected to one end of the passive arm 412.

A reversing gear 414 constituting the reversing component is rotatably supported by the lower surface of the upper wall of the drive support machine casing 82, at the side end toward the reversing plate 76. A reversing pin 416 constituting the reversing component is fixed to the reversing gear 414. The reversing pin 416 protrudes to the side of the reversing plate 76 from the drive support machine casing 82.

Figure 17:
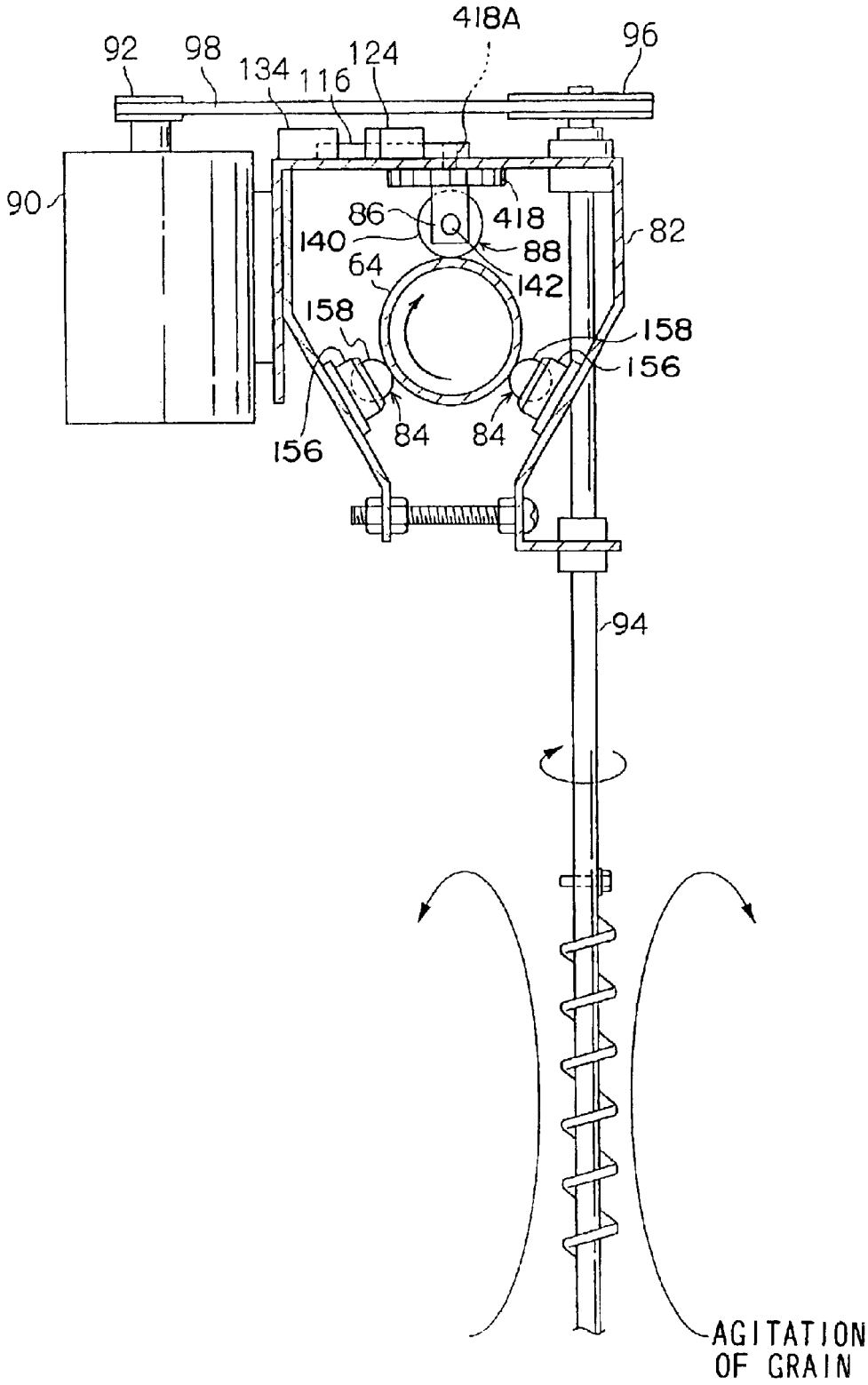
FIG. 17 is a partly broken side elevational view which shows the drive support machine casing of the agitating machine according to the third aspect of the invention.
Figure 18:
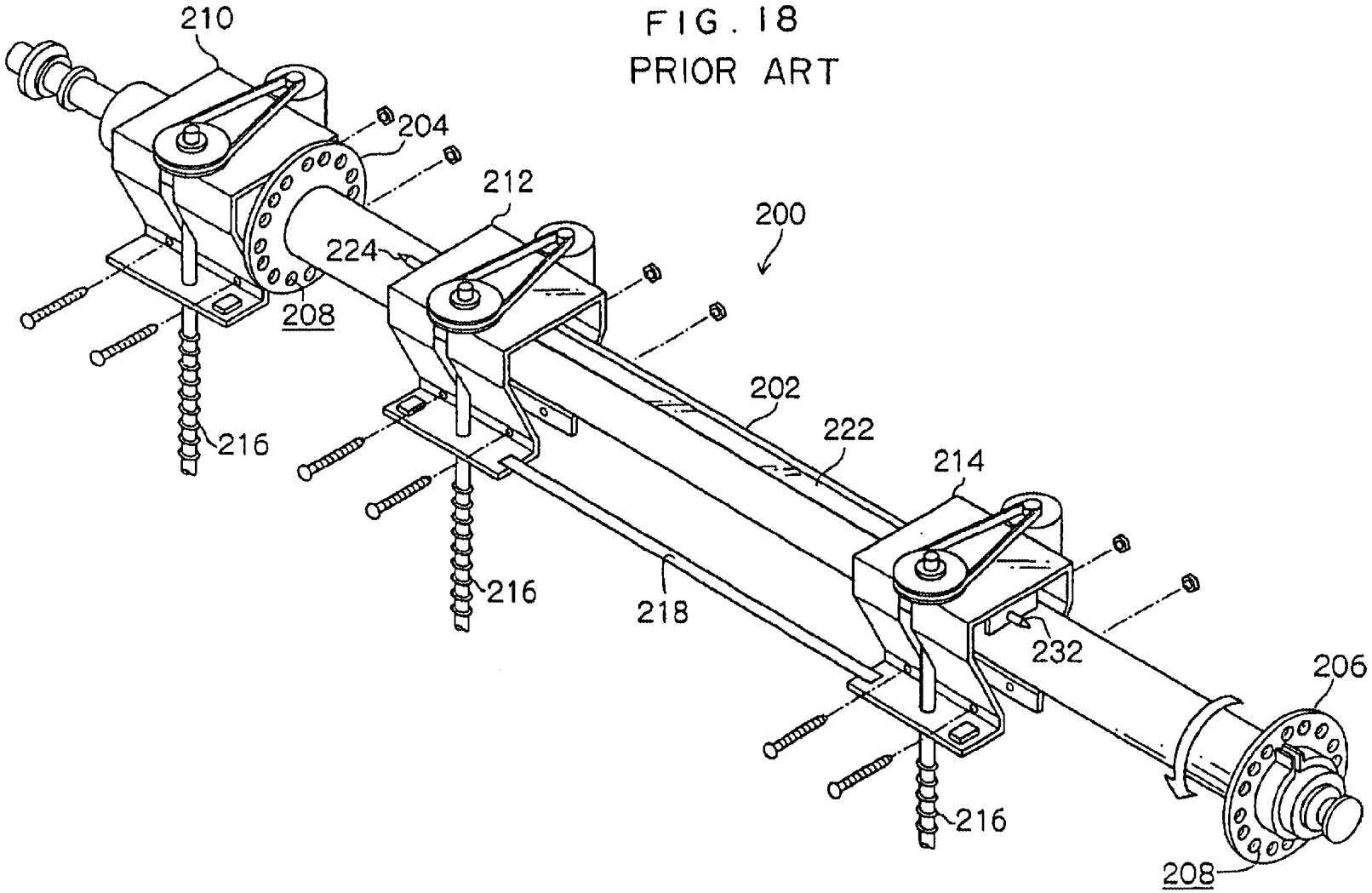
FIG. 18 PRIOR ART
FIG. 18 is a perspective view which shows a main portion of a conventional agitating machine.
Figure 19A:
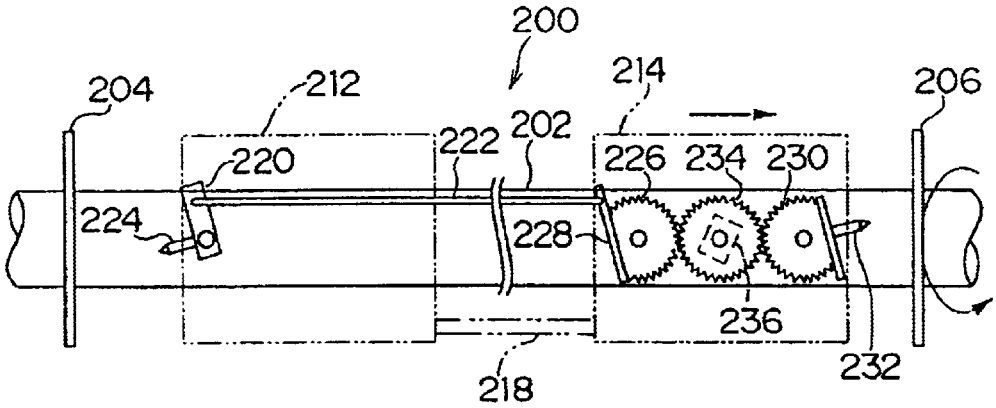
FIG. 19A PRIOR ART
Figure 19B:
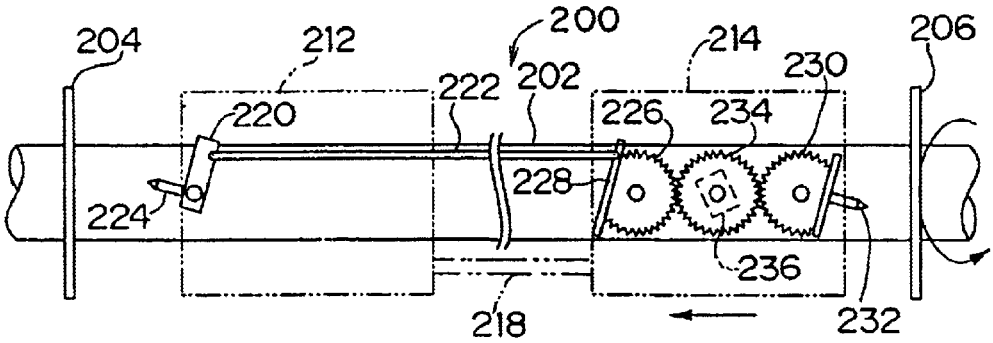
FIG. 19B PRIOR ART
Figure 20:
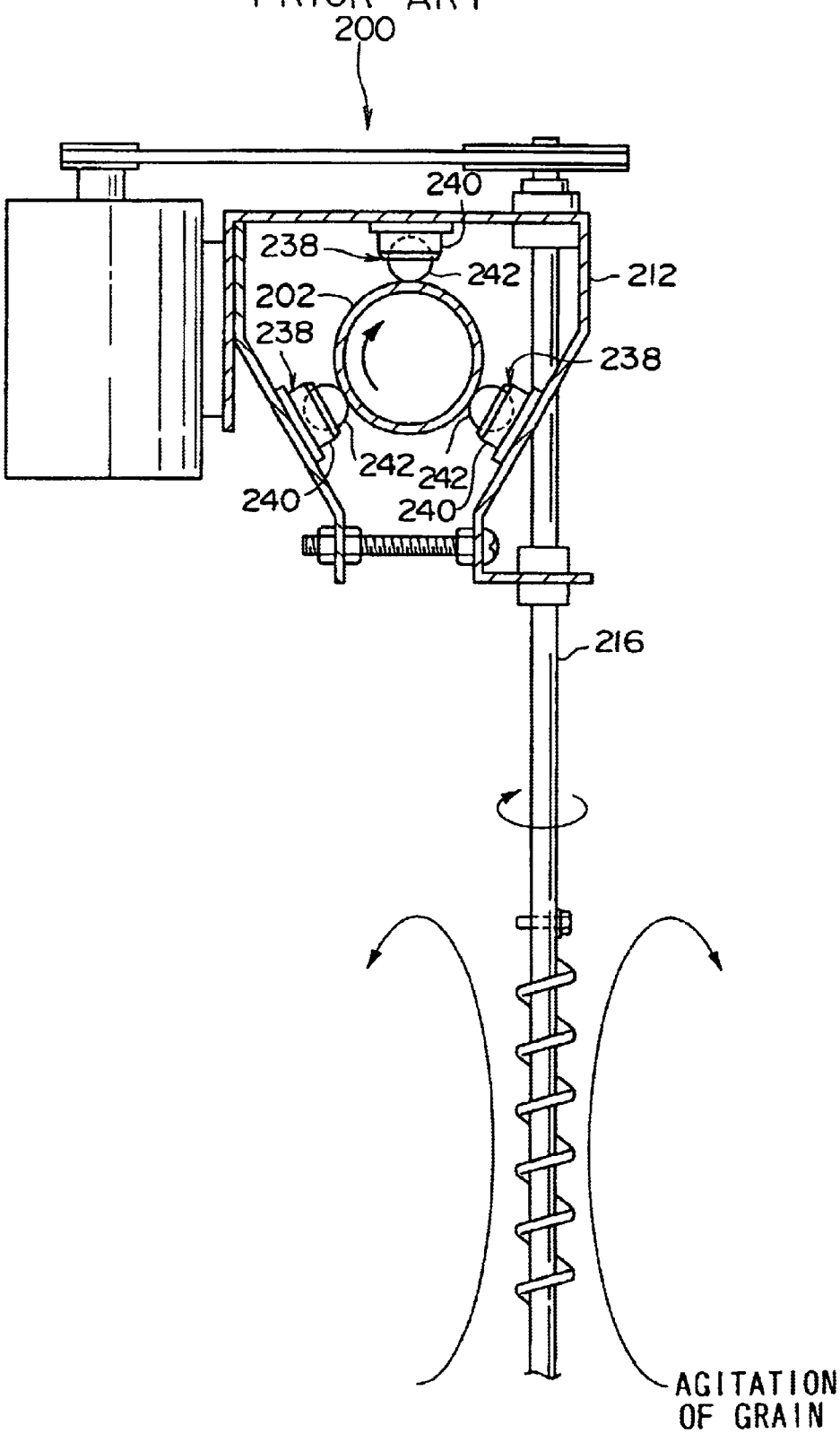
FIG. 20 PRIOR ART
FIG. 20 is a partly broken side elevational view which shows the driven support machine casing of the conventional agitating machine.

A support gear 418 corresponding to a rotating member constituting the reversing component is rotatably supported by the lower surface of the upper wall of the drive support machine casing 82, at a center thereof. The support gear 418 is engaged with the passive gear 410 and the reversing gear 414. As shown in FIG. 17, the upper surface center of the support frame 86 is fixed to a center shaft 418A of the support gear 418. The support gear 418 is rotated, whereby the direction of incline is changed in the axial direction of the drive roll 88 with respect to the axial direction of the guide shaft 64. Further, the center shaft 418A of the support gear 418 is inserted into the upper wall of the drive support machine casing 82, and protrudes to the upper side from the upper wall of the drive support machine casing 82.

In this case, as shown in FIG. 15A, when the axial direction of the drive roll 88 is inclined to the one side with respect to the axial direction of the guide shaft 64 (when the side of the drive roll 88 opposite to the rotation direction of the guide shaft 64 is inclined to the side of the reversing plate 76), the drive roll 88 is rotated around the peripheral surface of the guide shaft 64 which is rotated on its own axis, whereby the drive support machine casing 82 and the driven support machine casing 80 are moved to the side of the reversing plate 76 (the one end side of the guide shaft 64). At this time, the reversing pin 416 is inclined to the side opposite to the rotation direction of the guide shaft 64 with respect to the axial direction of the guide shaft 64. Further, the reversing pin 408 is inclined to the side of the rotation direction of the guide shaft 64 with respect to the axial direction of the guide shaft 64.

Thereafter, when the drive support machine casing 82 has reached the reversing plate 76 (when the drive roll 88 has been moved to the movement limit position at the one end side of the guide shaft 64), the reversing pin 416 is inserted into the oblong hole 402 of the reversing plate 76. Accordingly, the reversing pin 416 is inclined to the side of the rotation direction of the guide shaft 64 with respect to the axial direction of the guide shaft 64, and the reversing gear 414 and the support gear 418 are rotated. Therefore, as shown in FIG. 15B, the axial direction of the drive roll 88 is inclined to the another side with respect to the axial direction of the guide shaft 64 (the side of the drive roll 88 opposite to the rotation direction of the guide shaft 64 is inclined to the side of the reversing plate 74), and the drive roll 88 is rotated around the peripheral surface of the guide shaft 64 which is rotated on its own axis, whereby the drive support machine casing 82 and the driven support machine casing 80 are moved to the side of the reversing plate 74 (the another end side of the guide shaft 64). Further, the passive gear 410 (the passive arm 412) is rotated due to the rotation of the support gear 418, and the reversing arm 404 is rotated via the reversing rod 406. Accordingly, the reversing pin 408 is inclined to the side opposite to the rotation direction of the guide shaft 64 with respect to the axial direction of the guide shaft 64.

Further, when the driven support machine casing 80 has reached the reversing plate 74 (when the drive roll 88 has been moved to the movement limit position at the another end side of the guide shaft 64), the reversing pin 408 is inserted into the oblong hole 402 of the reversing plate 74. Accordingly, as again shown in FIG. 15A, the reversing pin 408 is inclined to the side of the rotation direction of the guide shaft 64 with respect to the axial direction of the guide shaft 64, and the reversing arm 404 is rotated. Therefore, the passive gear 410 (the passive arm 412) and the support gear 418 are rotated via the reversing rod 406, whereby the axial direction of the drive roll 88 is inclined to the one side with respect to the axial direction of the guide shaft 64. Therefore, the drive support machine casing 82 and the driven support machine casing 80 are moved to the side of the reversing plate 76. Further, the reversing gear 414 is rotated due to the rotation of the support gear 418. Accordingly, the reversing pin 416 is inclined to the side opposite to the rotation direction of the guide shaft 64 with respect to the axial direction of the guide shaft 64.

Accordingly, the movement of the drive support machine casing 82 and the driven support machine casing 80 to the one end side of the guide shaft 64 is reversed when the drive support machine casing 82 has reached the reversing plate 76. Further, the movement of the drive support machine casing 82 and the driven support machine casing 80 to the another end side of the guide shaft 64 is reversed when the driven support machine casing 80 has reached the reversing plate 74. Accordingly, the drive support machine casing 82 and the driven support machine casing 80 are oscillated between the reversing plate 74 and the reversing plate 76.

Figure 14:
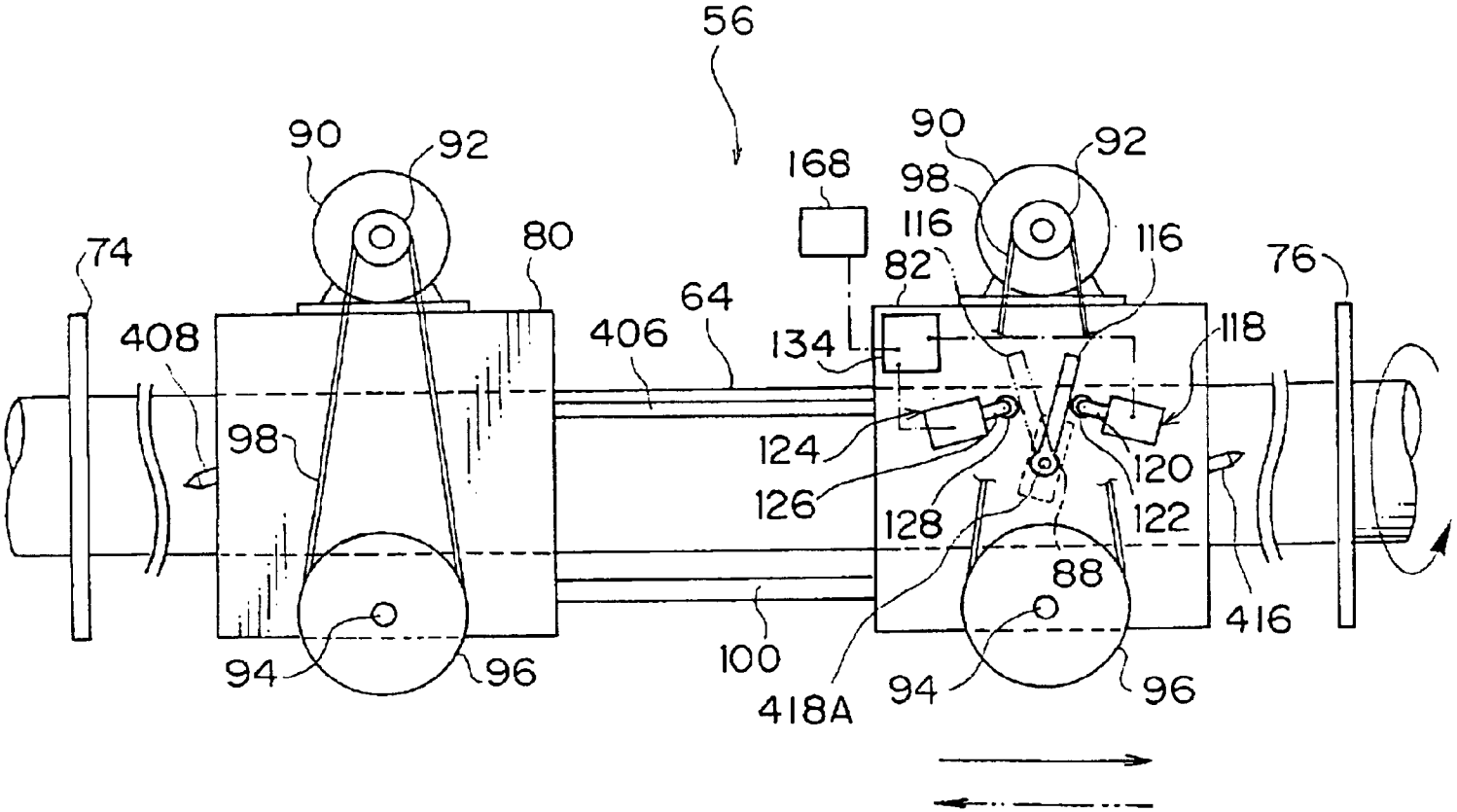
FIG. 14 is a plan view which shows a main portion of an agitating machine according to a third embodiment of the invention.

As shown in FIG. 14, a base end of the reversing lever 116 is fixed to the center shaft 418A of the support gear 418 (refer to FIG. 17). The reversing lever 116 is arranged perpendicularly to the axial direction of the drive roll 88.

In this case, the reversing lever 116 is rotated together with the drive roll 88 due to the rotation of the support gear 418, and the reversing lever 116 is in contact with the leading end (the detecting roll 122) of the projection portion 120 of the incline detecting apparatus 118, whereby it is detected that the axial direction of the drive roll 88 is inclined to the one side with respect to the axial direction of the guide shaft 64. Further, the reversing lever 116 is rotated together with the drive roll 88 due to the rotation of the support gear 418, and the reversing lever 116 is in contact with the leading end (the detecting roll 128) of the projection portion 126 of the incline detecting apparatus 124, whereby it is detected that the axial direction of the drive roll 88 is inclined to the another side with respect to the axial direction of the guide shaft 64.

In the case when a state in which the incline detecting apparatus 118 does not detect the incline of the axial direction of the drive roll 88 to the one side with respect to the axial direction of the guide shaft 64 (the contact of the reversing lever 116 with the leading end of the projection portion 120), and the incline detecting apparatus 124 does not detect the incline of the axial direction of the drive roll 88 to the another side with respect to the axial direction of the guide shaft 64 (the contact of the reversing lever 116 with the leading end of the projection portion 126) continues for more than a predetermined amount of time (an amount of time required for the direction of incline of the axial direction of the drive roll 88 with respect to the axial direction of the guide shaft 64 to be changed from one side to another side) (corresponding to in a case when the driving roll 88 is defective in incline with respect to the guide shaft 64, such as in a case when the reversing lever 116 stops between the incline detecting apparatus 118 and the incline detecting apparatus 124), the driving of the rotating motor 62, each of the agitating motors 90 and the dry wind generating apparatus 46 is stopped by the control apparatus 134, and the operation is all stopped. Further, in this case, the warning apparatus 168 gives the warning according to the control of the control apparatus 134.

The arrival detecting apparatus 102 is not provided on the upper surface of the upper wall of the driven support machine casing 80. Further, the structure is made such that the arrival detecting apparatus 108, the reversing motor 114 and the stoppers 130 and 132 are not provided on the upper surface of the upper wall of the drive support machine casing 82.

In this case, according to the present embodiment, it is possible to obtain the same effects as the effects obtained by the second embodiment mentioned above, except the effect obtained by the arrival detecting apparatuses 102 and 108, the reversing motor 114 and the control apparatus 134 being electrically driven.

In this case, according to the present embodiment, the structure is made such that the reversing pin 408, the reversing arm 404 and the reversing rod 406 are provided on the lower surface of the upper wall of the driven support machine casing 80. Further, the structure is made such that the reversing rod 406, the passive gear 410 (the passive arm 412), the support gear 418, the reversing gear 414 and the reversing pin 416 are provided on the lower surface of the upper wall of the drive support machine casing 82. However, the structure may be made such that the reversing pin, the reversing arm and the reversing rod are provided on the upper surface of the upper wall of the driven support machine casing. Further, the structure may be made such that the reversing rod, the passive gear (the passive arm), the support gear, the reversing gear and the reversing pin are provided on the upper surface of the upper wall of the drive support machine casing.

Further, according to the present embodiment, the structure is made such that the reversing lever 116, the incline detecting apparatuses 118 and 124 and the control apparatus 134 are provided on the upper surface of the upper wall of the drive support machine casing 82. However, the structure may be made such that the control apparatus is provided on the lower surface of the upper wall of the drive support machine casing or the driven support machine casing. Further, the structure may be made such that the reversing lever and the incline detecting apparatuses are provided on the lower surface of the upper wall of the drive support machine casing.

Further, in the second embodiment and the third embodiment mentioned above, the fixed support machine casing 78 may be made in the same structure as the driven support machine casing 80 shown in FIG. 12.

Further, according to the first through third embodiments, the structure is made such that the guide shaft 64 is rotated on its own axis around the center axis, and revolved around the one end side within the grain tank 12. However, in the case that the peripheral wall of the grain tank is formed in the rectangular tube shape or the like, the structure may be made such that the guide shaft is rotated on its own axis around the center axis and is oscillated in the axial perpendicular direction or the like within the grain tank.

What is claimed is:

1. A grain agitating apparatus comprising:

a guide shaft which is provided in a grain tank in which grain is stored;

a drive roll which is brought into contact with a peripheral surface of the guide shaft, is rotated around the peripheral surface of the guide shaft when an axial direction thereof is inclined to one side with respect to an axial direction of the guide shaft, thereby being moved to one end side of the guide shaft, and is rotated around the peripheral surface of the guide shaft when the axial direction thereof is inclined to another side with respect to the axial direction of the guide shaft, thereby being moved to another end side of the guide shaft;

a reversing component which is electrically driven, inclines the axial direction of the drive roll to the another side with respect to the axial direction of the guide shaft when it is detected that the drive roll has been moved to a movement limit position at the one end side of the guide shaft, and inclines the axial direction of the drive roll to the one side with respect to the axial direction of the guide shaft when it is detected that the drive roll has been moved to a movement limit position at the another end side of the guide shaft; and an agitating member which is moved integrally with the drive roll, is inserted into the grain, and agitates the grain.

2. A grain agitating apparatus according to claim 1, wherein the reversing component comprises:

a movement detecting component which detects that the drive roll has been moved to the movement limit position at the one end side of the guide shaft or at the another end side of the guide shaft; and an inclining component which inclines the axial direction of the drive roll to the another side or the one side with respect to the axial direction of the guide shaft when the movement detecting component detects that the drive roll has been moved to the movement limit position at the one end side of the guide shaft or at the another end side of the guide shaft.

3. A grain agitating apparatus according to claim 2, wherein the movement detecting component has a contacted member provided at the guide shaft, and a contact member moved integrally with the drive roll, and detects that the drive roll has been moved to the movement limit position at the one end side of the guide shaft or at the another end side of the guide shaft due to contact of the contact member with the contacted member.

4. A grain agitating apparatus according to claim 1, wherein the guide shaft is formed in a columnar shape or a cylindrical shape.

5. A grain agitating apparatus according to claim 1, wherein the drive roll is rotated around the peripheral surface of the guide shaft by the guide shaft being rotated on its own axis.

6. A grain agitating apparatus according to claim 1, wherein the agitating member is rotated on its own axis.

7. A grain storing apparatus comprising:

the grain agitating apparatus according to claim 1; and the grain tank.

8. A grain agitating apparatus comprising:

a guide shaft which is provided in a grain tank in which dry wind is blown and stored grain is dried;

a drive roll which is brought into contact with a peripheral surface of the guide shaft, is rotated around the peripheral surface of the guide shaft when an axial direction thereof is inclined to one side with respect to an axial direction of the guide shaft, thereby being moved to one end side of the guide shaft, and is rotated around the peripheral surface of the guide shaft when the axial direction thereof is inclined to another side with respect to the axial direction of the guide shaft, thereby being moved to another end side of the guide shaft;

a reversing component which inclines the axial direction of the drive roll to the another side with respect to the axial direction of the guide shaft when the drive roll has been moved to a movement limit position at the one end side of the guide shaft, and inclines the axial direction of the drive roll to the one side with respect to the axial direction of the guide shaft when the drive roll has been moved to a movement limit position at the another end side of the guide shaft; and an agitating member which is moved integrally with the drive roll, is inserted into the grain, and agitates the grain, wherein the grain agitating apparatus performs at least one of a process of stopping the blowing of dry wind into the grain tank and rotation of the drive roll with respect to the guide shaft peripheral surface, and a process of giving a warning, when the axial direction of the drive roll becomes parallel to the axial direction of the guide shaft.

9. A grain agitating apparatus according to claim 8, wherein the reversing component comprises:

a movement detecting component which detects that the drive roll has been moved to the movement limit position at the one end side of the guide shaft or at the another end side of the guide shaft; and an inclining component which inclines the axial direction of the drive roll to the another side or the one side with respect to the axial direction of the guide shaft when the movement detecting component detects that the drive roll has been moved to the movement limit position at the one end side of the guide shaft or at the another end side of the guide shaft.

10. A grain agitating apparatus according to claim 9, wherein the movement detecting component has a contacted member provided at the guide shaft, and a contact member moved integrally with the drive roll, and detects that the drive roll has been moved to the movement limit position at the one end side of the guide shaft or at the another end side of the guide shaft due to contact of the contact member with the contacted member.

11. A grain agitating apparatus according to claim 8, wherein the reversing component has a rotating member which is provided at the drive roll and is rotated by the drive roll having been moved to the movement limit position at the one end side of the guide shaft or at the another end side of the guide shaft, so as to incline the axial direction of the drive roll to the another side or the one side with respect to the axial direction of the guide shaft.

12. A grain agitating apparatus according to claim 8, further comprising an incline detecting component which detects that the axial direction of the drive roll is inclined to the one side or the another side with respect to the axial direction of the guide shaft.

13. A grain agitating apparatus according to claim 8, wherein the guide shaft is formed in a columnar shape or a cylindrical shape.

14. A grain agitating apparatus according to claim 8, wherein the drive roll is rotated around the peripheral surface of the guide shaft by the guide shaft being rotated on its own axis, and the rotation of the drive roll around the peripheral surface of the guide shaft is stopped by stopping the rotation of the guide shaft.

15. A grain agitating apparatus according to claim 8, wherein the agitating member is rotated so as to agitate the grain, and the rotation of the agitating member is stopped when the axial direction of the drive roll becomes parallel to the axial direction of the guide shaft.

16. A grain storing apparatus comprising:

the grain agitating apparatus according to claim 8; and the grain tank.

17. A grain agitating apparatus comprising:

a guide shaft which is provided in a grain tank in which grain is stored, and which is rotated on its own axis;

a guide rail which has a first roll provided rotatable around a center axis in a direction parallel to an axial direction of the guide shaft, is supported by the guide shaft due to the first roll being in contact with the guide shaft, and allows the guide shaft to rotate on its own axis;

a moving member which has a second roll provided rotatable around a center axis in a direction perpendicular to the axial direction of the guide shaft, is supported by the guide rail and is allowed to move in the axial direction of the guide shaft due to the second roll being in contact with the guide rail, and is moved in the axial direction of the guide shaft; and an agitating member which is moved integrally with the moving member, is inserted into the grain, and agitates the grain.

18. A grain agitating apparatus according to claim 17, wherein the guide shaft is formed in a columnar shape or a cylindrical shape, and is rotated on its own axis around a center axis.

19. A grain agitating apparatus according to claim 17, wherein the agitating member is rotated on its own axis.

20. A grain storing apparatus comprising:

the grain agitating apparatus according to claim 17; and the grain tank.

* * * * *